US006520729B1

(12) United States Patent
Gibson

(10) Patent No.: US 6,520,729 B1
(45) Date of Patent: Feb. 18, 2003

(54) FREIGHT CONTAINER AND METHOD OF TRANSPORTING A LOAD

(75) Inventor: David A. Gibson, Walsgrave (GB)

(73) Assignee: 3rd Planet Solutions Limited, Walsgrave (GB)

( * ) Notice: Subject to any disclaimer, the term of this patent is extended or adjusted under 35 U.S.C. 154(b) by 0 days.

(21) Appl. No.: 09/600,601

(22) PCT Filed: Jan. 13, 1999

(86) PCT No.: PCT/GB99/00110

§ 371 (c)(1),
(2), (4) Date: Jul. 19, 2000

(87) PCT Pub. No.: WO99/54182

PCT Pub. Date: Oct. 28, 1999

(30) Foreign Application Priority Data

Jan. 19, 1998 (GB) ..... 9801073

(51) Int. Cl.[7] ..... B65G 69/00

(52) U.S. Cl. ..... 414/679; 414/339; 414/340; 414/343; 414/351; 414/353; 198/465.2

(58) Field of Search ..... 414/679, 339, 414/340, 343, 349, 351, 352, 353, 390, 400, 528, 529, 535; 198/370.1, 349, 349.6, 349.7, 465.2

(56) References Cited

U.S. PATENT DOCUMENTS 2,437,486 A 3/1948 Staiger
2,691,450 A * 10/1954 Rosenbaum
3,416,684 A * 12/1968 Barry
3,504,636 A 4/1970 Alder
3,709,381 A * 1/1973 Sullivan et al. ..... 198/349.7
3,749,268 A * 7/1973 Macomber et al.
3,999,671 A * 12/1976 Lutz
4,291,797 A * 9/1981 Ewertowski ..... 198/349
4,658,947 A * 4/1987 Welder ..... 198/370.1
5,609,236 A * 3/1997 Neukam ..... 198/370.1
5,795,123 A * 8/1998 Lovgren

FOREIGN PATENT DOCUMENTS

DE 43 06 960 10/1993
DE 94 10 660 11/1995
DE 44 40 172 5/1996

* cited by examiner

*Primary Examiner*—Joseph E. Valenza
(74) *Attorney, Agent, or Firm*—Pillsbury Winthrop LLP

(57) ABSTRACT

Apparatus is provided for transporting a load from a source to a destination. The apparatus includes a freight container (1) which has a plurality of cells (7) each for containing a discrete load and a conveyor (10) for conveying loads between cells (7). Plural discrete loads are loaded into the container (1). The loads are allocated amongst the cells (7) according to the destinations of the individual loads and then each individual load is conveyed to its allocated cell (7).

16 Claims, 30 Drawing Sheets

FREIGHT CONTAINER AND METHOD OF TRANSPORTING A LOAD

This application is the national phase of international application PCT/GB99/00110 filed Jan. 13, 1999 which designated the U.S.

BACKGROUND OF THE INVENTION

The present invention relates to a freight container and to a method for transporting a load. The invention has particular applicability to a rail freight container.

There are numerous types of rail freight wagons already in existence. A basic type of rail freight wagon uses the wagon itself as the container for a load. In another type, a separate standard container unit is lifted on and off a flat bed rail wagon by special cranes. In a third type, known as a "piggy-back" wagon, a rail wagon accommodates a road vehicle such as a truck or articulated lorry which is driven on and off the rail wagon at special loading points.

Very few freight journeys can be made entirely by rail. There is nearly always a requirement for transport of the freight by road or other means at one or both ends of the rail journey. The freight therefore needs to be switched between transport modes usually at least once in what is known as an "intermodal freight operation".

Existing intermodal rail freight systems require a relatively large investment in terms of both monetary cost and physical space at switching points where freight is transferred from road to rail or from rail to road. This severely restricts the number of available switching points and hence the flexibility that such known systems can provide.

For intermodal road/rail freight transport to be economic with existing wagon types, relatively long distances and large amounts of freight are invariably required between the source and the destination in order for the lower running costs per unit load to counteract the additional costs associated with mode switching. This has been one of the main limiting factors preventing more widespread use of intermodal road/rail freight in preference to road only. It is therefore desirable to increase the available number of switching points which in turn requires that the cost and complexity of the switching points be reduced and to reduce the amount of time required to switch loads between road and rail.

In addition, unless dedicated freight lines are available, it is a fundamental requirement for freight services that they fit in with passenger services timetables. This either means large, slow, infrequent, freight services or smaller, faster, more frequent services. The former is predominant at the present time. There are increasing market pressures for moves towards the latter, due to the "just-in-time" delivery requirements of customers.

It is desirable to run mixed passenger/freight services to make maximum use of available slots on the rail network. With existing systems, issues such as health and safety and speed of loading/unloading limit the freight aspect of mixed traffic to carriage of light parcels.

Rail freight systems that interface with air freight are being examined more closely by the transport industry. Airports such as London Heathrow are being severely limited in their freight growth by the present road aspect of the transport chain. The carriage of palletised freight to the heart of a city by surface or underground train is becoming the preferred solution, although present rail systems cannot easily provide this solution.

SUMMARY OF THE INVENTION

According to a first aspect of the present invention, there is provided a freight container for transporting a load from a source to a destination, the container comprising: a plurality of cells each for containing a discrete load; a conveyor for conveying loads between cells; and, a controller for allocating the loads amongst the cells according to the destinations of the individual loads and controlling the conveyor to convey each load to its allocated cell.

At a particular source, loads can be loaded into the container in a fairly random manner with loads being received in unoccupied cells. The loads can then be redistributed between cells within the container so as to group together different loads intended for the same destination. Sorting and redistribution of the loads can take place whilst the container is in transit. When a destination is reached, all of the loads for that destination can be discharged from the container very rapidly. Furthermore, a long series of connected containers, such as in a freight train, can be used with a loading/unloading station or platform which is shorter than the series of connected containers as it is only necessary for the container or containers which include loads for that destination to be parked adjacent the loading/unloading station or platform.

The freight container may include the controller. Alternatively, one or more controllers may be provided separately from the freight container or containers, perhaps at a central fixed location, the controller or controllers communicating with the container or containers, and with each other as necessary, via suitable data communication links such as by radio or via power transmission lines for example. Where a plurality of containers are connected to each other in series, a controller for controlling all of the connected containers may be located in just one of the containers or in a tractor unit for the connected containers for example.

The cells may be arranged in a horizontal plane. Preferably, the cells are arranged in a horizontal array.

In a preferred embodiment, the conveyor comprises means in each cell for unloading a load from the cell.

The conveyor may comprise means for selectively moving a load into and out of a cell in a direction selected from at least two directions for each cell.

In a preferred embodiment, the conveyor comprises means for selectively moving a load into and out of a cell in a direction selected from a direction parallel to the direction of travel of the container and transverse to the direction of travel of the container.

The container preferably comprises means for reading a destination address on a load and providing destination information for each load to the controller. This allows the controller to determine how to redistribute the loads within the container so as to group together the loads as required in a simple manner.

The conveyor may comprise at least one driven roller in each cell for carrying a load and moving said load in a first direction. The conveyor may comprise means in each cell for moving said load in a second direction, the second direction moving means being operable to lift a load from the at least one driven roller to allow said load to be moved in said second direction. The second direction moving means may comprise at least one belt. The first and second directions may for example be parallel to and transverse to the direction of travel of the container.

Each cell may be separated from an adjacent cell by a divider which is movable to allow loads to be conveyed between adjacent cells. A detector may be provided for detecting when a load abuts a divider, the controller being operable on receipt of a signal from the detector indicating that a load abuts a divider to control the conveyor to move said load away from said divider.

The container may have plural access points for loading and unloading of loads.

Alternatively, the container may have a single access point for loading and unloading of loads.

There may be a plurality of containers as described above, each of said containers being connected to at least one other container such that a load can be transferred from one container to another container.

According to a second aspect of the present invention, there is provided a method of transporting plural discrete loads in a container from at least one source to respective destinations, the container having a plurality of cells each for containing a discrete load, the method comprising the steps of: loading said plural discrete loads into the container; identifying which loads are intended for which destinations; allocating the loads amongst the cells according to the destinations of the individual loads; and, conveying each load to its allocated cell.

Preferably, the loads are all initially loaded into cells of the container, and the method comprises the step of redistributing the loads amongst the cells according to the destinations of the individual loads.

The loads may be allocated amongst the cells so that all loads in the container intended for the same destination are conveyed to adjacent or substantially adjacent cells.

The conveying step is preferably carried out whilst the container is in transit between a source and a destination.

According to a third aspect of the present invention, there is provided in combination: a freight container having a plurality of cells each for containing a discrete load and a controller for allocating the loads amongst the cells according to the destinations of the individual loads; and, a loading/unloading station for loading loads into and unloading loads from the container, the loading/unloading station comprising a controller which has a data link to the container controller so that the loading/unloading station controller can determine the location of cells in the container which contain loads to be unloaded from the container by the loading/unloading station and which cells in the container are unoccupied; and, means for unloading loads from cells in the container and for loading loads into cells in the container.

BRIEF DESCRIPTION OF THE DRAWINGS

An embodiment of the present invention will now be described by way of example with reference to the accompanying drawings, in which.

DETAILED DESCRIPTION OF PREFERRED EMBODIMENTS

Figure 1B:
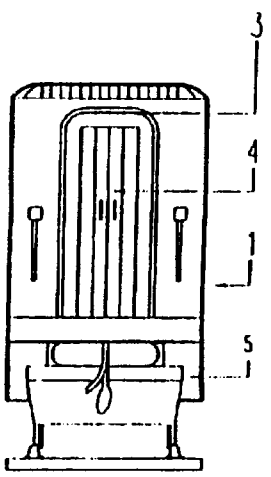
FIG. 1A is a side elevation and FIG. 1B is an end elevation of a first example of a container according to the present invention.
Figure 1A:
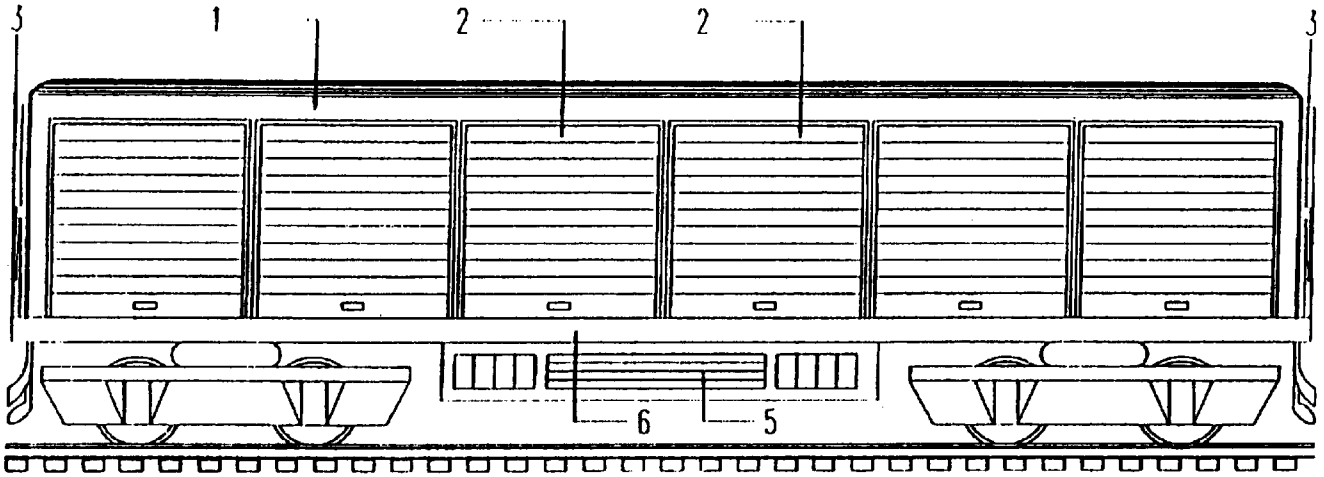

Referring to the drawings, a freight container 1 in the form of a rail freight wagon 1 is shown in FIGS. 1A and 1B. The wagon 1 has six roll-up access doors 2 on each side of the wagon 1. Each end of the wagon 1 has a corridor connection 3 for connecting the wagon 1 to another freight wagon and optionally to allow loads to be loaded into and unloaded from the wagon 1 at its ends. Concertina-type doors 4 are provided for closing each of the corridor connections 3. An under-floor housing 5 contains various control equipment for the wagon 1 including a controller which may be in the form of a computer for example.

Figure 2:
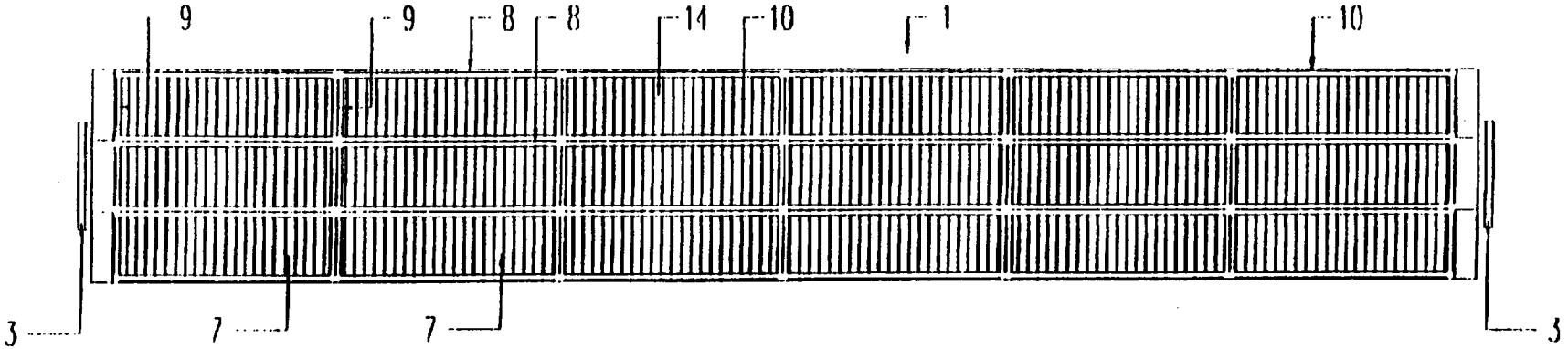
FIG. 2 is a plan view from above of the inside of the container of FIG. 1.

As shown in FIG. 2, the floor 6 of the wagon 1 is divided into individual compartments or cells 7. In the example shown, the cells 7 are arranged in a horizontal array of 6×3 cells 7. The cells 7 are separated from one another by longitudinal dividers 8 parallel to the direction of travel of the wagon 1 and lateral dividers 9 transverse to the direction of travel of the wagon 1. The dividers 8,9 will be described further below. Each cell 7 has a conveyor 10 for moving loads into and out of the cell 7 and which will also be described further below.

Figure 3:
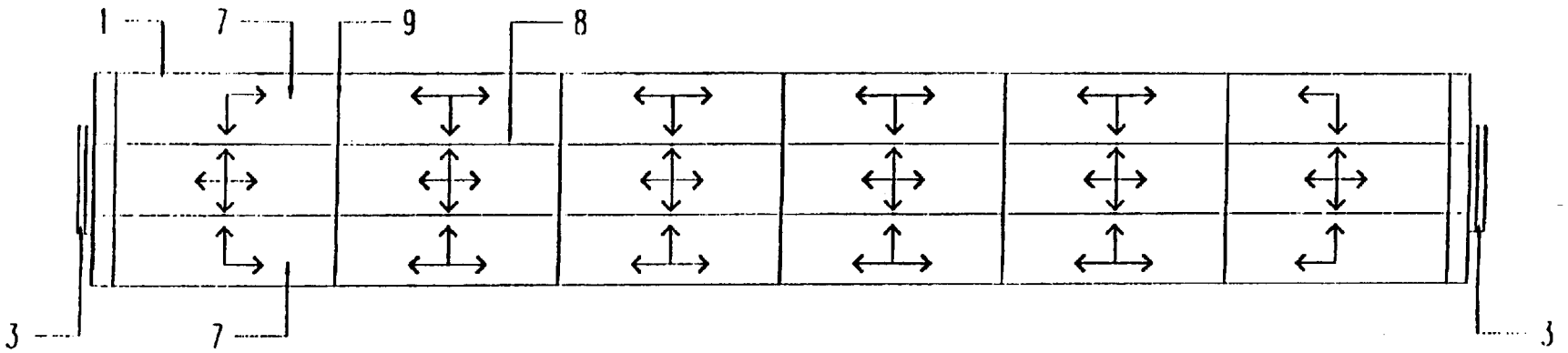
FIG. 3 is a schematic plan view from above of the inside of the container of FIG. 1 showing the possible directions of movement of loads between cells of the container.

FIG. 3 shows for each cell 7 the direction of possible movement for a load into and out of that cell 7 to an adjacent cell 7. As will be seen, in the specific example, a load can be transferred from one cell 7 to any of the other cells 7 adjacent the first cell 7 in a direction parallel or transverse to the direction of travel of the wagon 1. In other words, longitudinal and lateral movement of the loads between adjacent cells 7 is possible.

Figure 4:
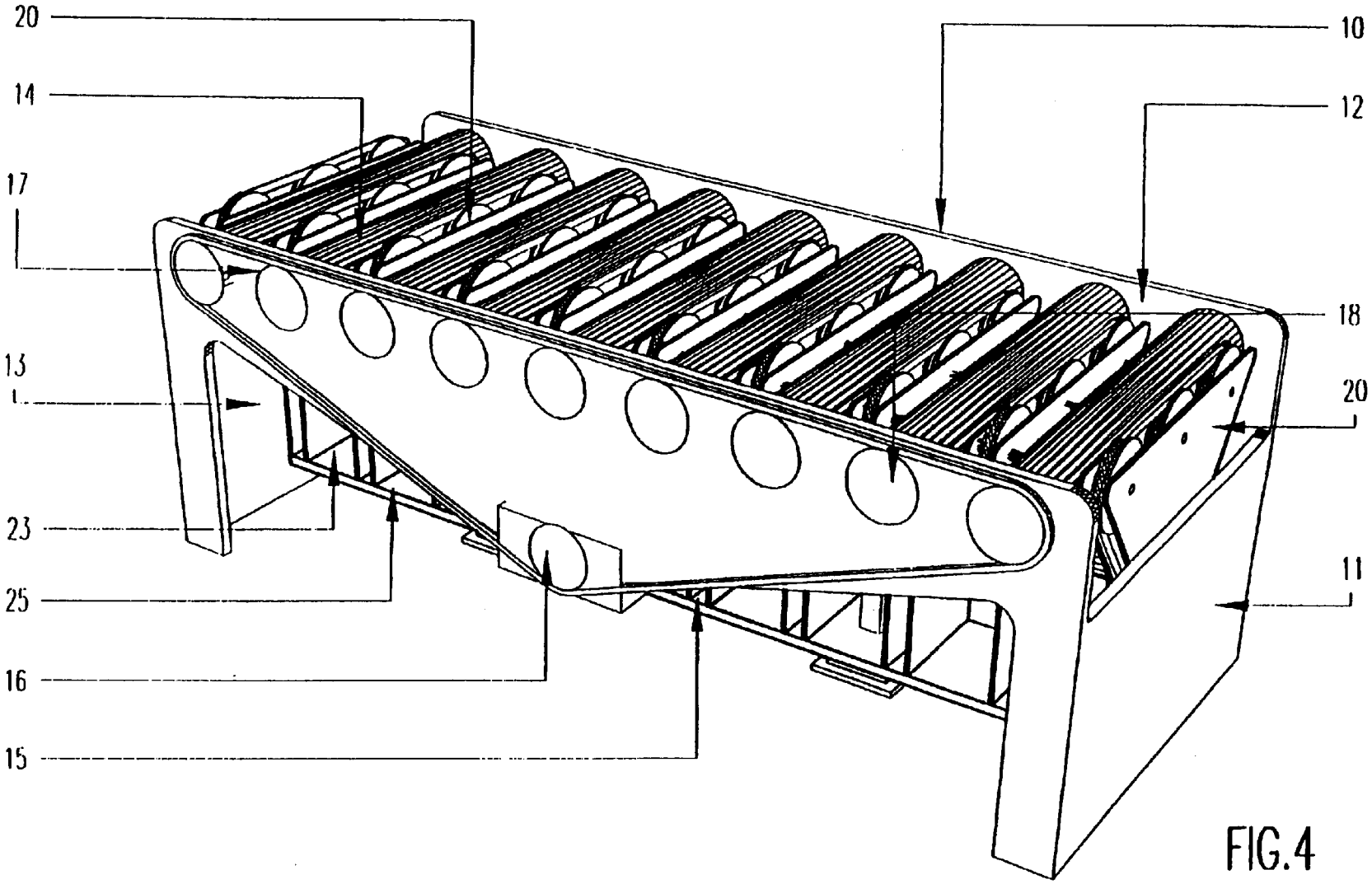
FIG. 4 is a schematic perspective view of a conveyor of one of the cells of the container of FIG. 1.

An example of a conveyor 10 of one of the cells 7 is shown in FIG. 4. The conveyor 10 has a frame 11 which is fixed to the floor 6 of the wagon 1. The frame 11 has two long side walls 12, 13 which project upwardly from the floor 6 and which are parallel to the direction of travel of the wagon 1. A motor 15 selectively drives a drive wheel 16 carried by the frame 11. The drive wheel 16 in turn drives the rollers 14 via a drive belt 17 which engages with the drive wheel 16 of the motor 15 and drive wheels 18 at the end of each roller 14. Each of the rollers 14 is coated with or made of a high friction material, such as rubber. Thus, a load positioned on and carried by the rollers 14 can be moved in a direction parallel to the direction of travel of the wagon 1 by rotation of the rollers 14.

Figure 5:
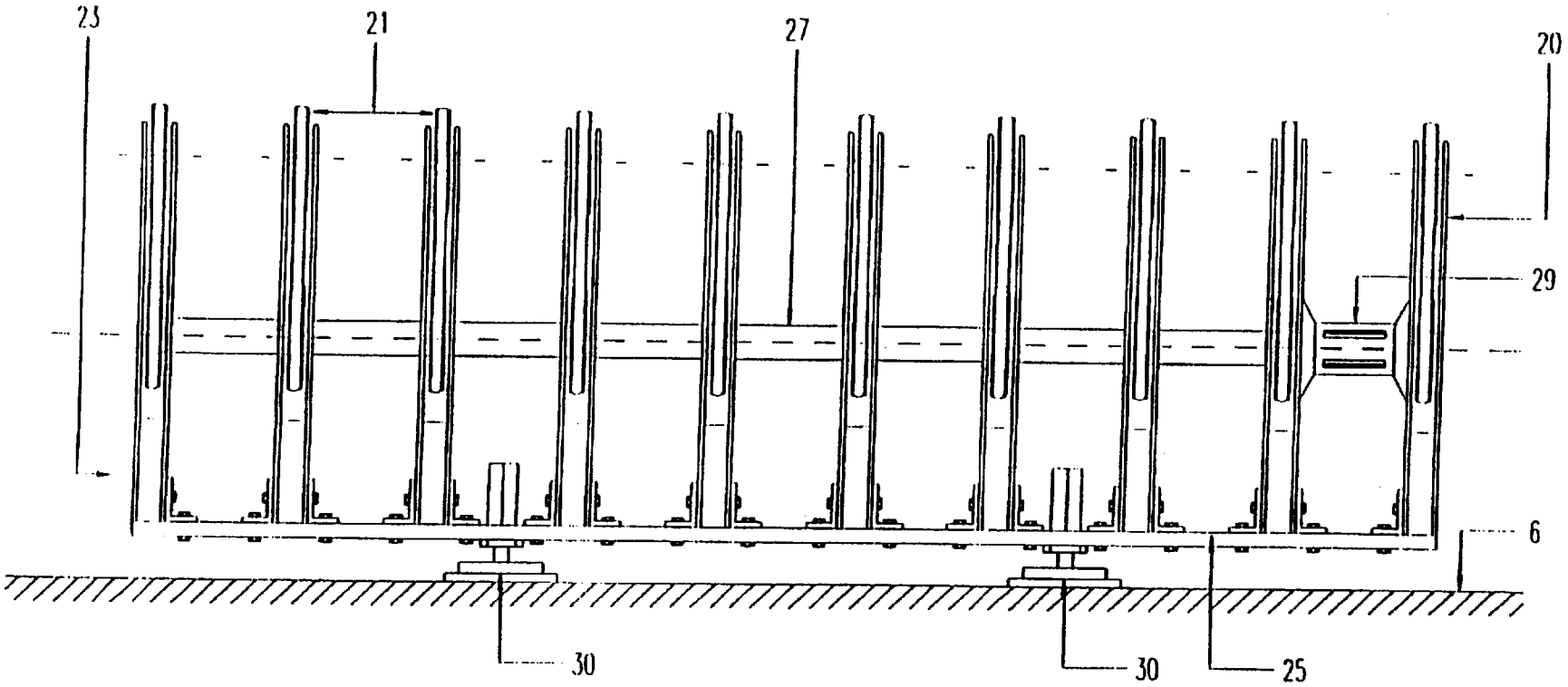
FIG. 5 is a side elevation of the conveyor of FIG. 4 showing only the mechanism for moving loads transversely of the container.
Figure 6B:
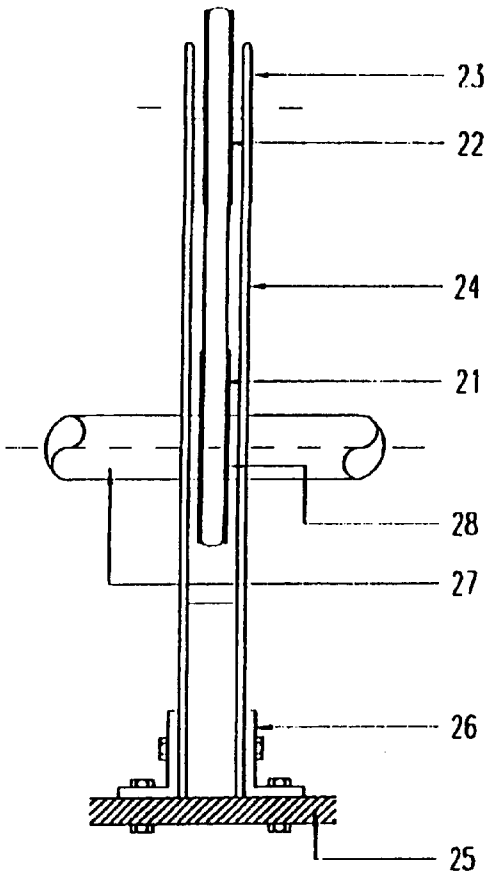
FIG. 6A is an end elevation and FIG. 6B is a side elevation of one of the components of the transverse conveyor.
Figure 6A:
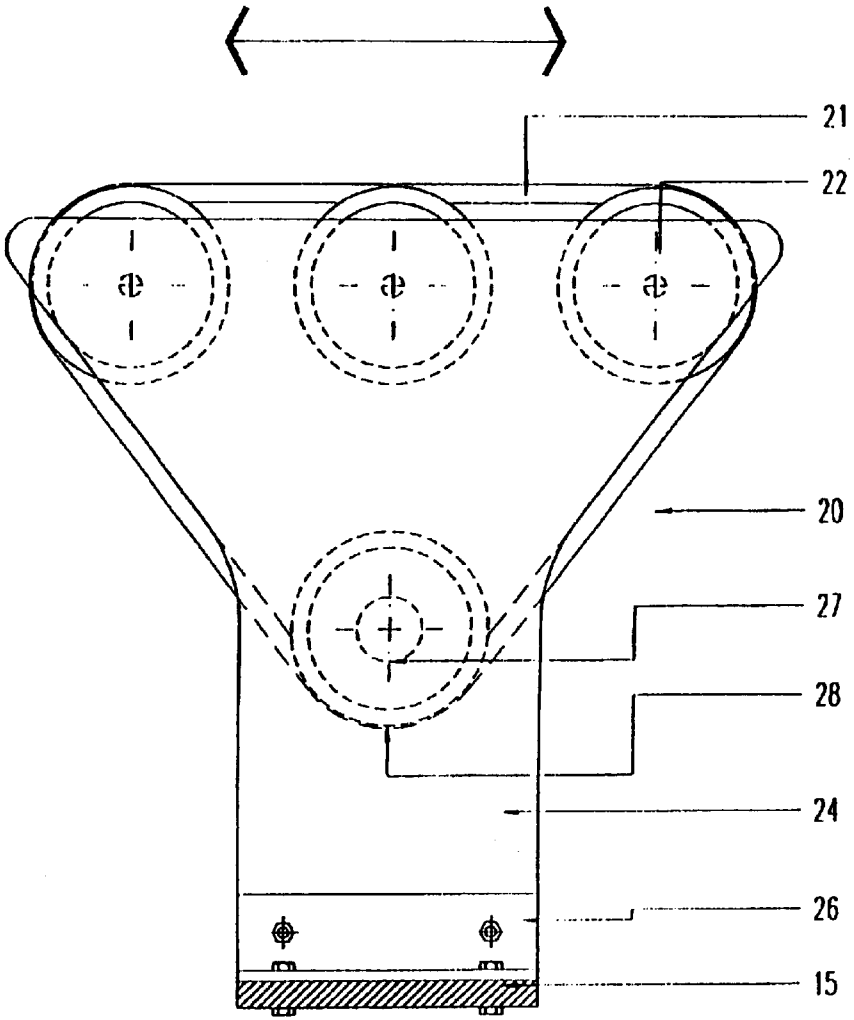

The conveyor 10 for each cell 7 includes ten belt mechanisms 20 for moving a container laterally or transverse to the direction of travel of the wagon 1. The transverse belt mechanisms 20 are shown in more detail in FIGS. 5 and 6. Each of the transverse belt mechanisms 20 includes a belt 21 of high friction material, such as rubber, which is arranged to be driven in a vertical plane. The belt 21 is supported at its uppermost portion by three identical freely rotating wheels 22 which are arranged with their centres of rotation to be collinear and which extend across the conveyor 10 transversely to the direction of travel of the wagon 1. The belt 21 is therefore horizontal at its uppermost portion as shown particularly clearly in FIG. 6A. Each of the freely rotating wheels 22 of the belt mechanism 20 is supported by a vertically arranged frame 23 which includes two vertically arranged side plates 24 between which are mounted the freely rotating wheels 22. Each of the side plates 24 of the ten frames 23 for the belt mechanisms 20 of a cell 7 is fixed at its lowermost end to a common rigid elongate bar 25 via brackets 26. The elongate bar 25 provides a common base for the ten belt mechanisms 20 for each cell 7.

A common drive shaft 27 passes through the side plates 24. A drive wheel 28 for each belt mechanism 20 is fixed to or integrally formed with the drive shaft 27. Each drive wheel 28 is located between the side plates 24 of the frame 23 of its belt mechanism 20. The belt 21 of each belt mechanism 20 passes round the drive wheel 28 for that belt mechanism 20. The drive shaft 27 is selectively driven by a motor 29 so that all of the belts 21 of each of the belt mechanisms 20 for a particular cell 7 are driven in tandem in one direction or the other transverse to the direction of travel of the wagon 1.

The elongate bar 25 is supported on the floor 6 of the wagon 1 by two lifters 30 which are fixed to the floor 6 of the wagon 1. The two lifters 30 can be driven in tandem to selectively raise or lower the bar 25 and therefore all of the belt mechanisms 20 of a particular cell 7. In the normal position, the lifters 30 are at their lowermost position so that the tops of the belts 21 of the belt mechanisms 20 lie below the uppermost surface of the rollers 14 of the conveyor 10 so that a load is supported only by the rollers 14. In this configuration, a load can be held stationary in the cell 7 by the rollers 14 or the rollers 14 can be driven to move a load out of the cell 7 in a direction parallel to the direction of travel of the wagon 1. In order to move a load transversely to the direction of travel of the wagon 1, the lifters 30 are driven to raise the belt mechanisms 20 so that the uppermost portion of each of the belts 21 of the belt mechanisms 20 are raised above the rollers 14 so that the load is then supported only by the belts 21. The drive shaft 27 for the belts 21 can then be driven in the appropriate direction in order to drive the belts 21 and therefore to move the load in one direction or the other transverse to the direction of travel of the wagon 1.

It will be appreciated that when a cell 7 is receiving a load, the rollers 14 or the belts 21 can be driven appropriately according to the direction from which the load is being conveyed so that the load can be received or carried into that cell 7.

It will further be appreciated that different types of mechanisms for moving loads between cells 7 may be provided in addition to or instead of the rollers and belts described above.

Figure 7A:
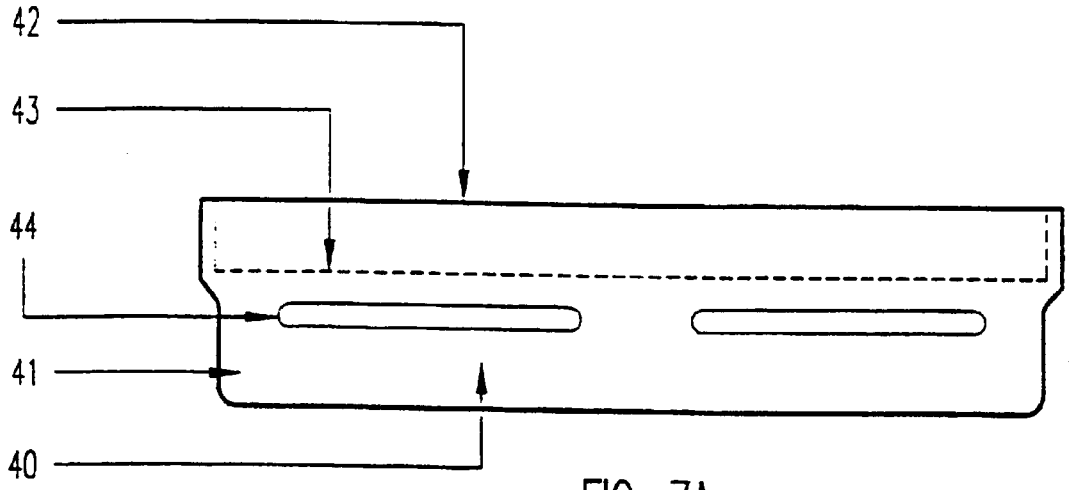
FIG. 7A, FIG. 7B and FIG. 7C are respectively a side elevation, a plan view from above, and an end elevation of a pallet.
Figure 7B:
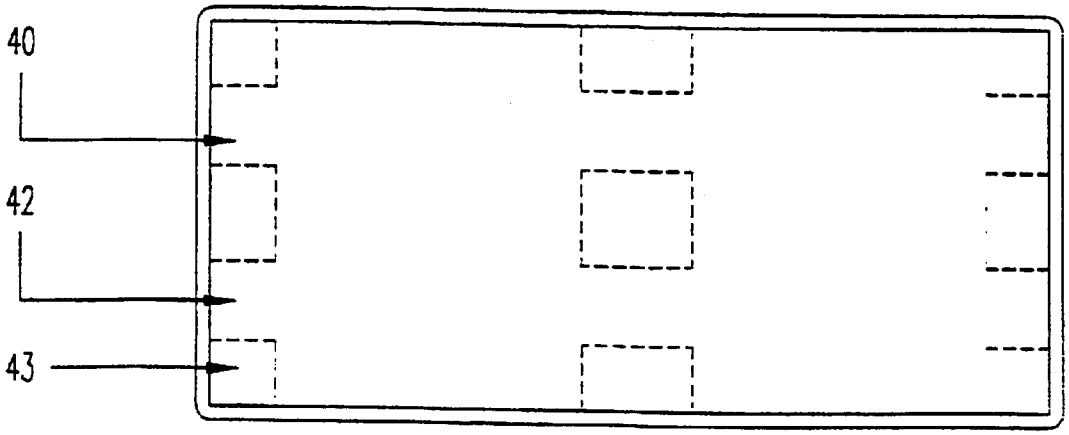
Figure 7C:
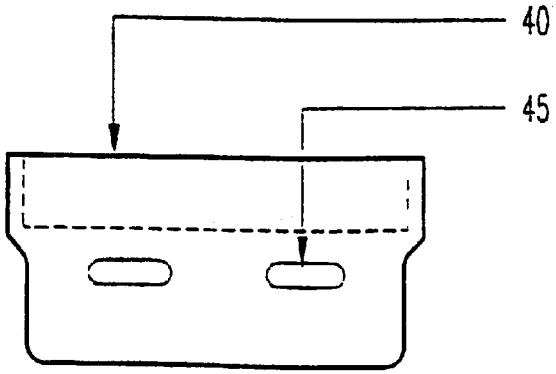

A pallet 40 suitable for carrying loads is shown in FIG. 7. The pallet 40 has a hollow lower compartment 41 and an upper compartment 42 which is open at its uppermost portion. The lower and upper compartments 41,42 are separated by a floor 43 of the upper compartment 42 on which loads are actually carried. The upper compartment 42 is defined by side walls 43 which lie outside the periphery of the base compartment 41 so that empty pallets 40 can be stacked in order to save space. The base compartment 41 has through holes 44 in its side walls and through holes 45 in its end walls each of which can receive the forks of a fork lift truck or other loading/unloading mechanism to lift the pallet 40. Because the pallets 40 together with loads are moved around within a wagon 1, it is desirable for the centre of mass of the combined load and pallet 40 to be as low as possible. The hollow compartment 41 of the pallet 40 can be filled with ballast as required in order to lower the centre of mass. A range of pallets 40 having different amounts of ballast in the lower compartment 41 may be provided.

Figure 8:
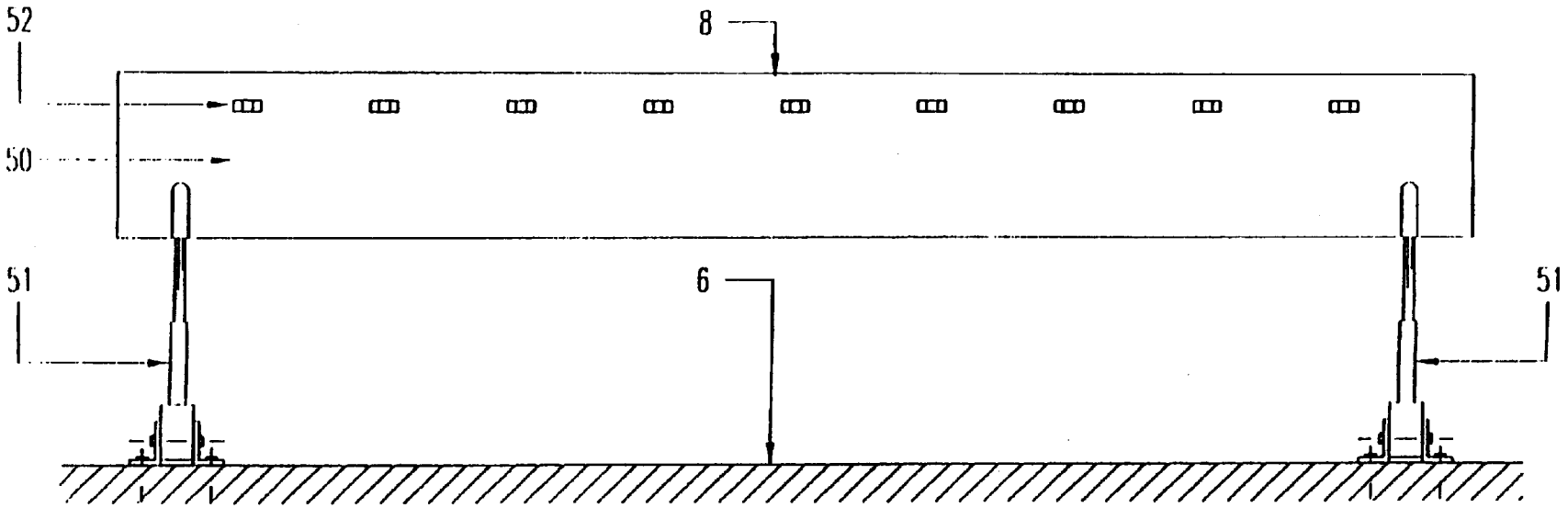
FIG. 8 is a side elevation of a divider.

One of the dividers 8 which separates transversely adjacent cells 7 is shown in more detail in FIG. 8. The lateral dividers 9 which separate longitudinally adjacent cells 7 are of similar construction. Each of the dividers 8,9 has a wall 50 which extends the whole length or width of the cell 7 as the case may be. Each dividing wall 50 is carried on two lifters 51 which are each fixed to the floor 6 of the wagon 1 and which can be operated to raise or lower the dividing wall 50 as required. In the normal configuration as shown for example in FIG. 9, each dividing wall 50 of each of the dividers 8,9 is in its uppermost position so that at least a major portion of the dividing wall 50 is above the height of the conveyor 10 for each cell 7 so that any load in that cell 7 is contained by the dividing walls 50 of the dividers 8,9 associated with that cell 7. In order to allow a load to be moved into or out of a cell 7 by appropriate operation of the conveyor 10, the appropriate lateral or longitudinal divider 8,9 is operated to lower the appropriate dividing wall 50 so that a load can be moved into or out of the cell 7. The dividing wall 50 is then raised again. Each of the dividing walls 50 has a series of freely rotating wheels 52 which project from the surface of the wall 50 and rotate about a vertical axis to guide a load during movement of that load into or out of a cell 7 and which therefore prevent any high friction which might otherwise arise through contact between the load and the dividing wall 50 from inhibiting or preventing movement of the load.

Figure 9:
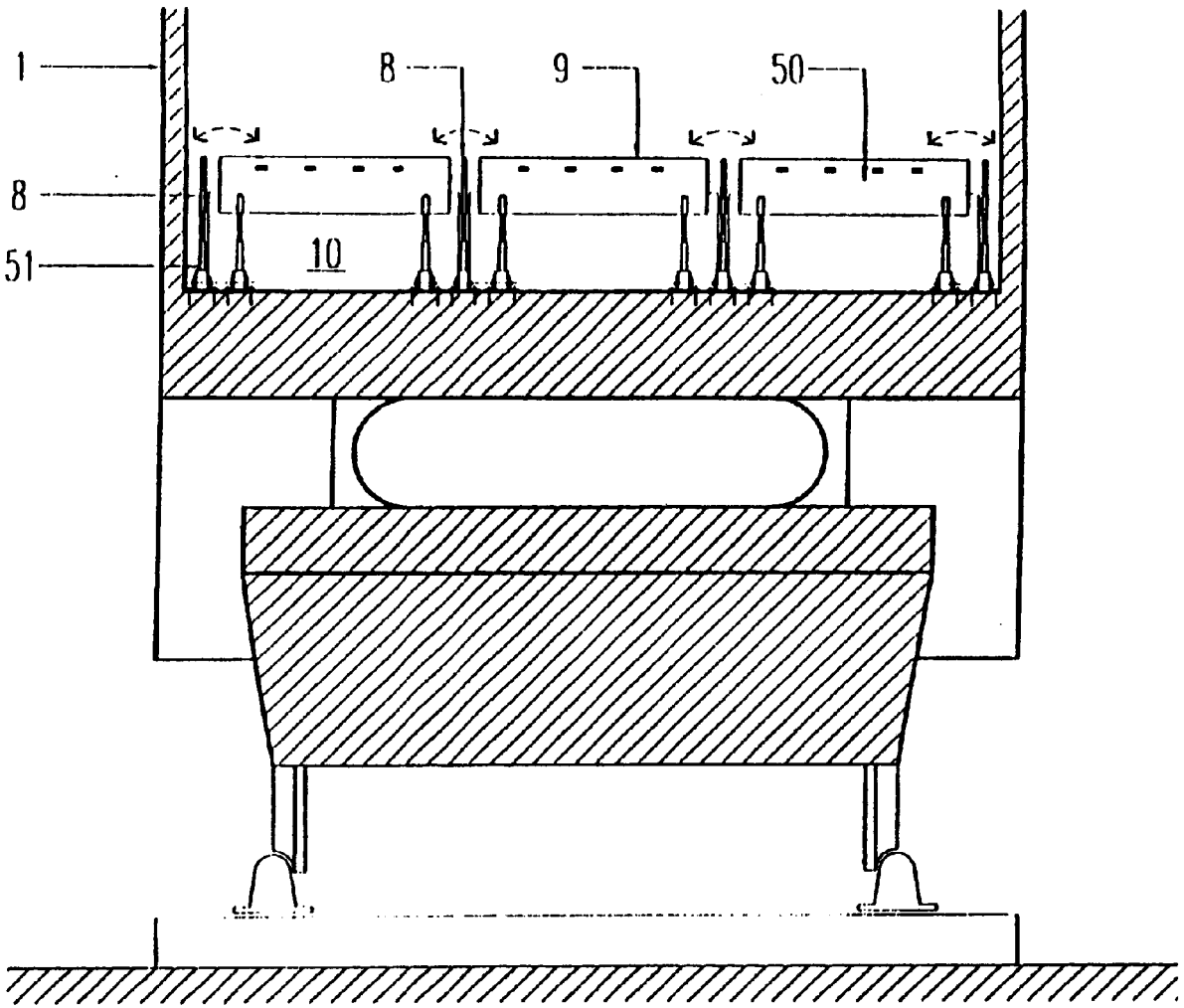
FIG. 9 is a schematic transverse cross-sectional view of the container of FIG. 1.
Figure 10:
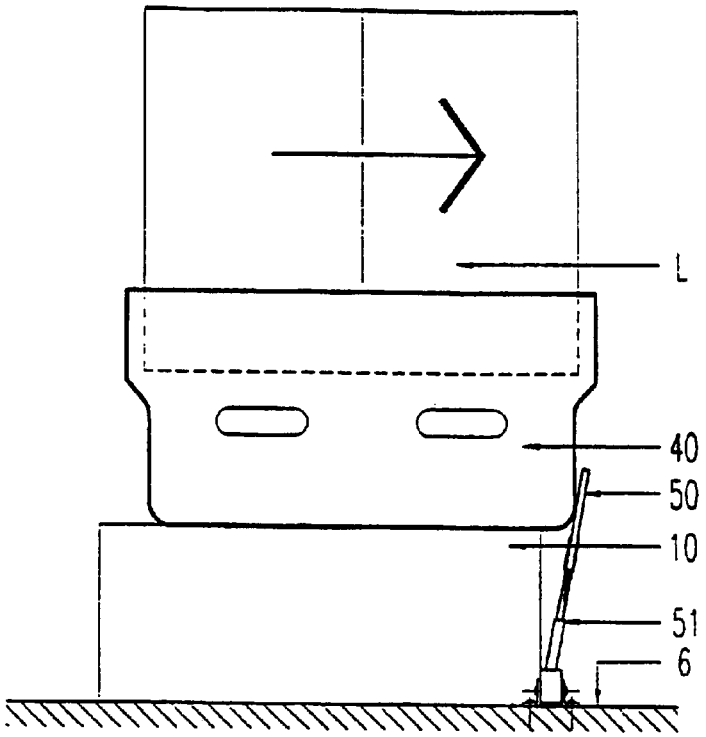
FIG. 10 shows a pallet abutting a divider.
Figure 11:
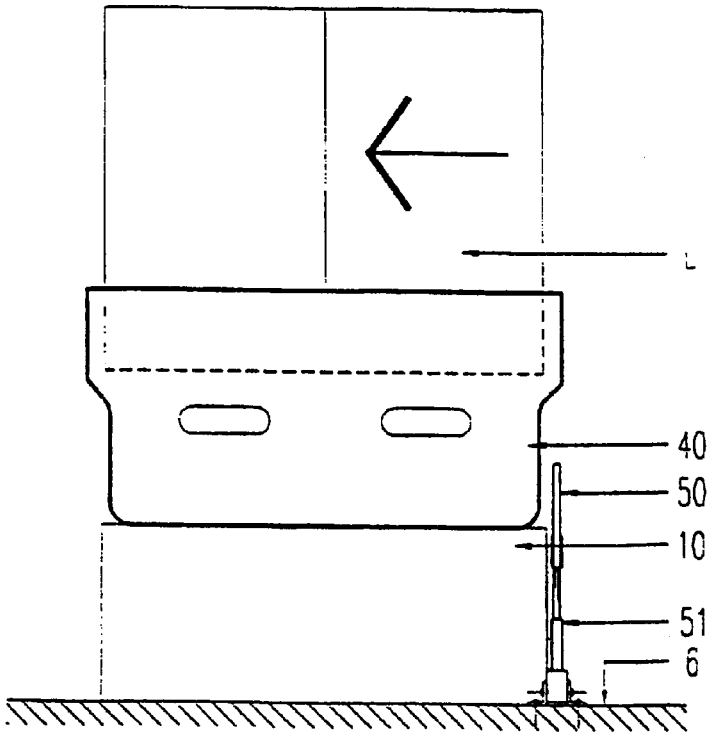
FIG. 11 shows the pallet of FIG. 10 having been moved away from the divider.

It may be that loads are able to slide within a cell 7 despite the high friction nature of the rollers 14 of the conveyor 10 which normally support the load. The lifters 51 of the dividers 8,9 may be arranged so that they can flex in a direction perpendicular to the dividing wall 50 carried by those lifters 51 as indicated in FIGS. 9 and 10. The lifters 51 may be sprung-loaded to restore them to their vertical position. The lifters 51 preferably include a sensor (not shown), perhaps at the base of the lifters 51, to detect when a load L on its pallet 40 abuts a dividing wall 50. The output of the sensors is passed to the controller. On detection of sideways movement of a dividing wall 50, the controller can control the conveyor 10 for the cell 7 concerned to drive the load L and pallet 40 back to the centre of the cell 7 as indicated in FIG. 11. It will be appreciated that, in this embodiment, the main function of the dividers 8,9 is to allow detection of when a load has moved away from the centre of its cell 7, allowing correction of the position by the conveyor 10. This may alternatively be achieved by other motion detectors such as infra red beams. However, the dividers 8,9 described above also function as walls to contain the loads in their cells 7.

Figures 12, 13A, 13B:
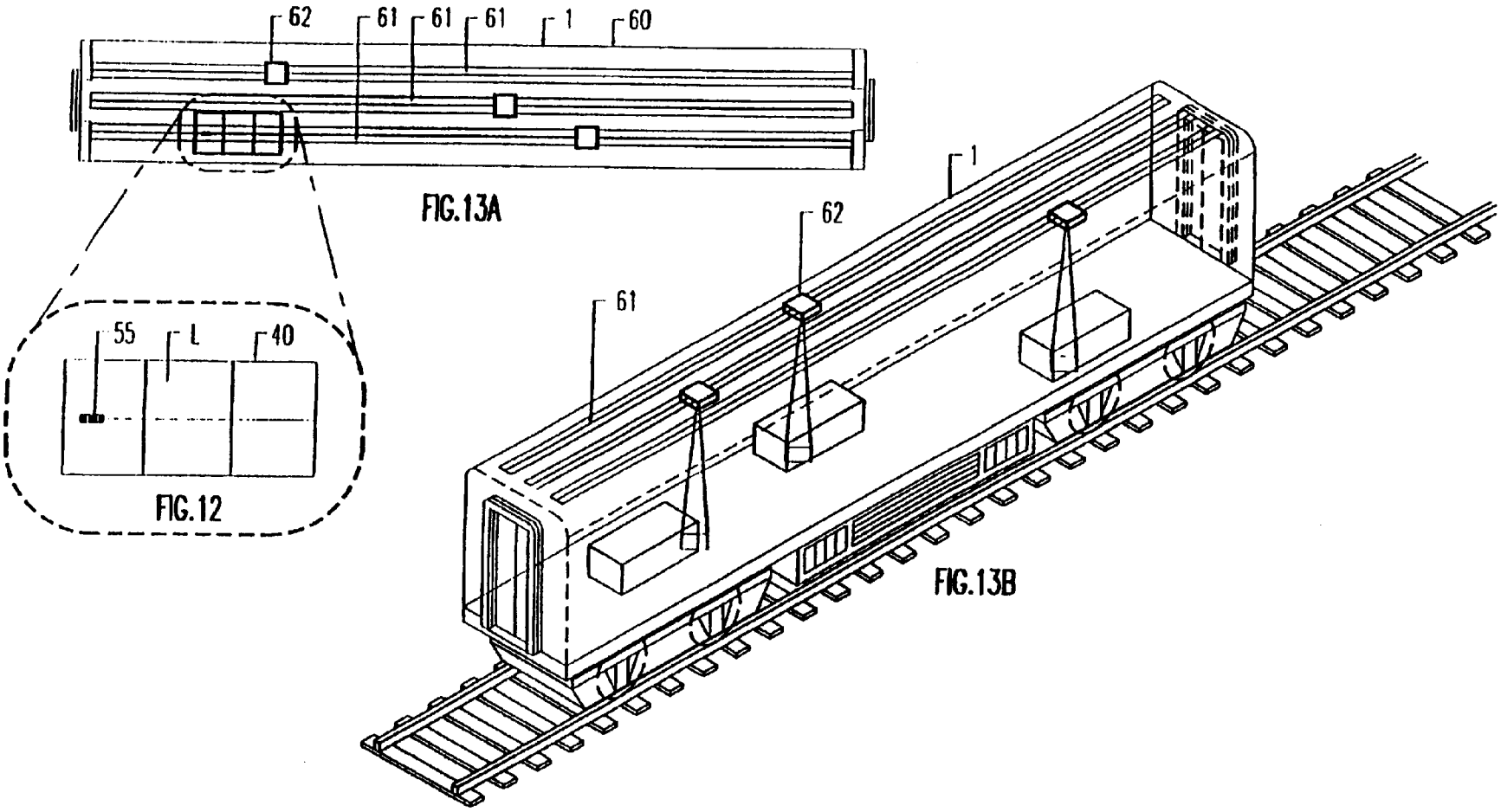
FIG. 12 is a plan view from above of a loaded pallet.
FIG. 13A is a view from below of the inside of the roof of the container of FIG. 1
FIG. 13B is a perspective view showing the inside of the container.

As shown in FIG. 12, a pallet 40 carrying a load L has a label 55 fixed on the uppermost surface of the load L. The label 55 includes at least information indicating the destination for that load L. The information may be stored in machine-readable form such as a bar code, magnetic strip, etc. As shown in FIGS. 13A and 13B, the under surface of the roof 60 of the wagon 1 has three parallel tracks 61 which run the length of the roof 60 over the three rows of cells 7 arranged along the length of the wagon 1. Each track 61 carries a reader 62 such as a bar code reader, magnetic head, etc suitable for reading the label 55 on the load L and supplies power to the reader 62. The readers 62 can be automatically moved up and down the tracks 61 to allow the labels 55 of all loads L in the wagon 1 to be read. The destination information and any other information read from the label 55 is passed from the readers 62 to the controller. The position of the reader 61 on its track 60 and the identity of the reader 61 itself allows the controller to determine the location of the cell 7 of the load L whose label 55 has been read.

Figure 14:
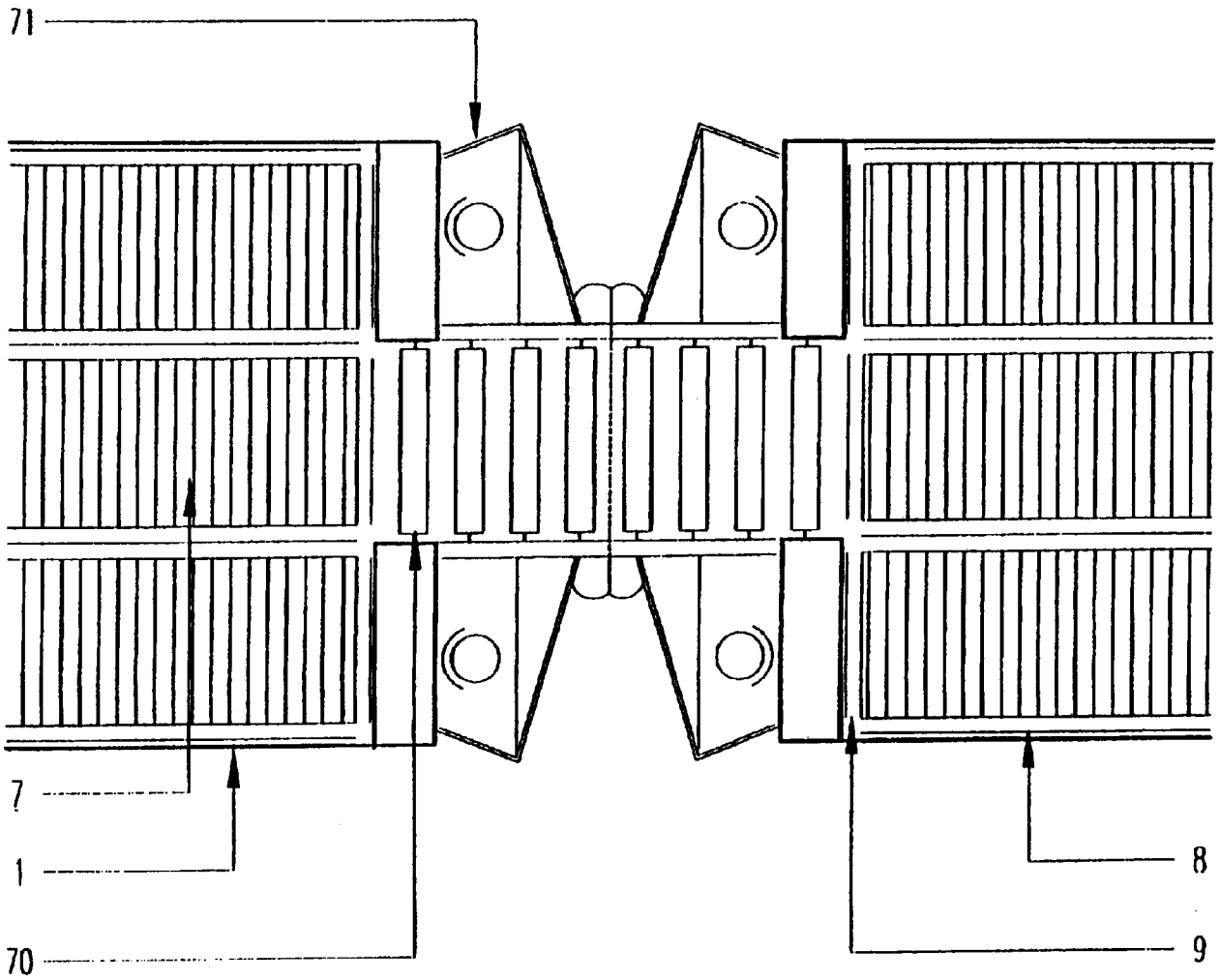
FIG. 14 is a plan view from above showing the connection between two containers.

The connection between two wagons 1 is shown in FIG. 14. The wagons 1 are connected at their corridor connections 3. Each corridor connection 3 includes a set of powered rollers 70 arranged to be rotated about a horizontal axis and which are used to transfer loads from one wagon 1 to the other wagon 1. The corridor rollers 70 are slightly wider than the cells 7 so that a load can be transferred between the wagons 1 in transit even when the wagons 1 are travelling around a curve. Cabs 71 for the driver of the wagon 1 may be provided on each wagon 1. Of course, the connection between two wagons 1 may be full width which allows the three rows of cells 7 across each wagon to connect to each other.

Figure 15:
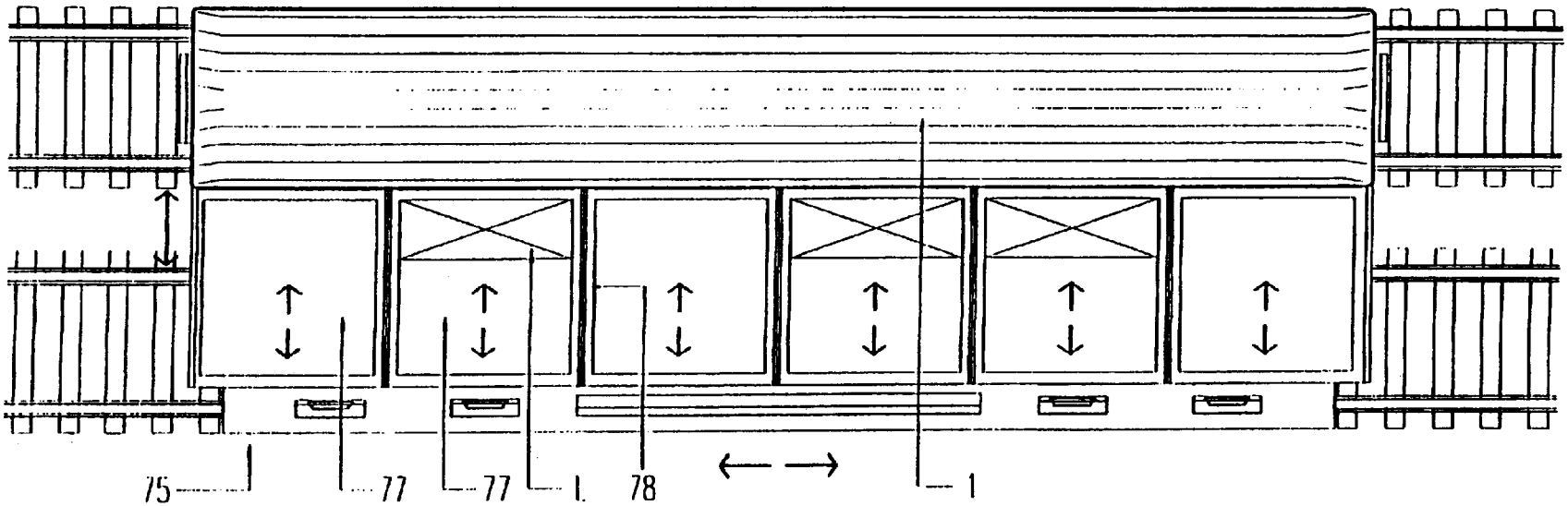
FIG. 15 is a plan view from above of the container of FIG. 1 adjacent a loading/unloading wagon.
Figure 16:
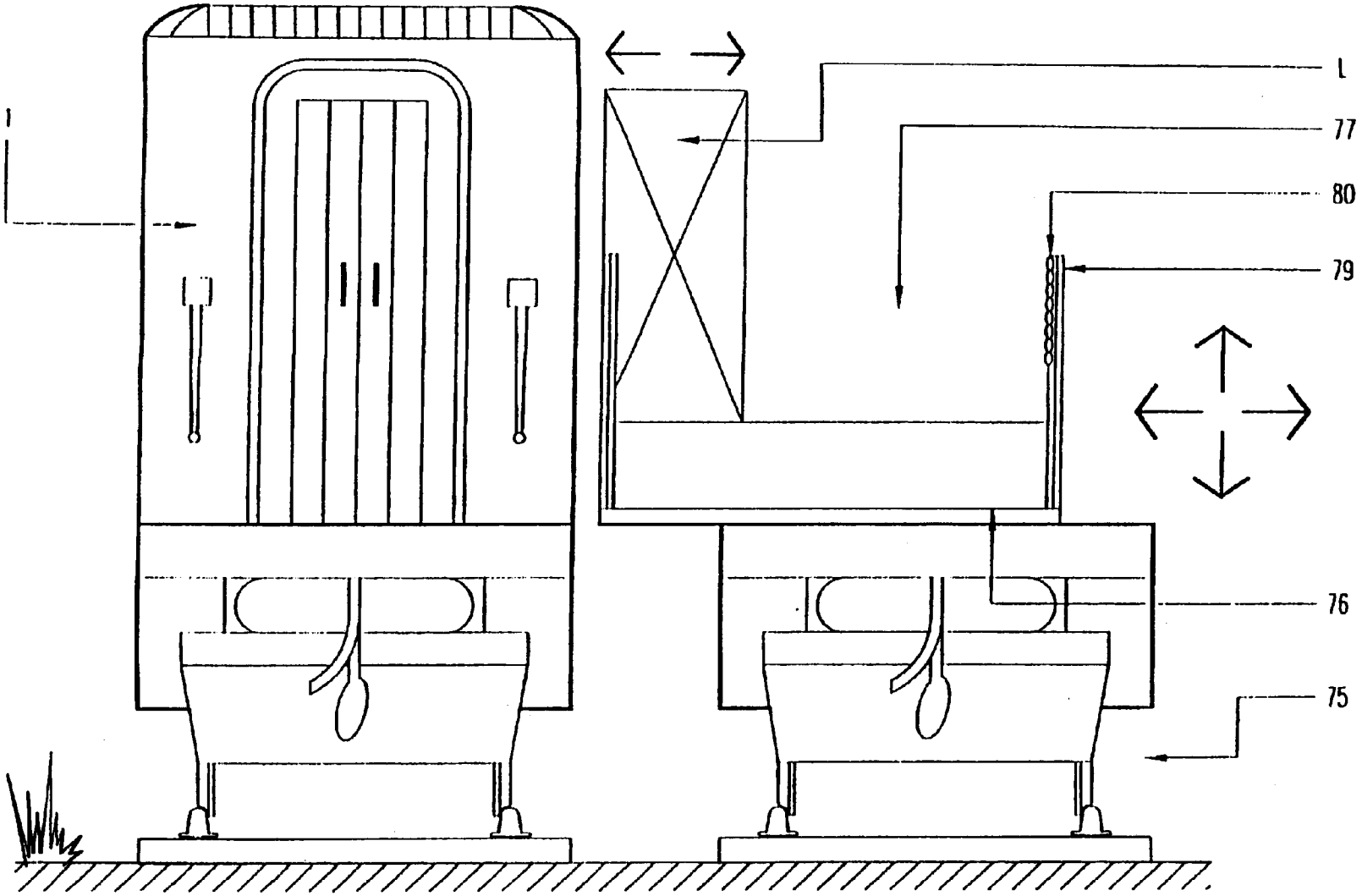
FIG. 16 is an end view of the container and loading/unloading wagon of FIG. 15.
Figure 17:
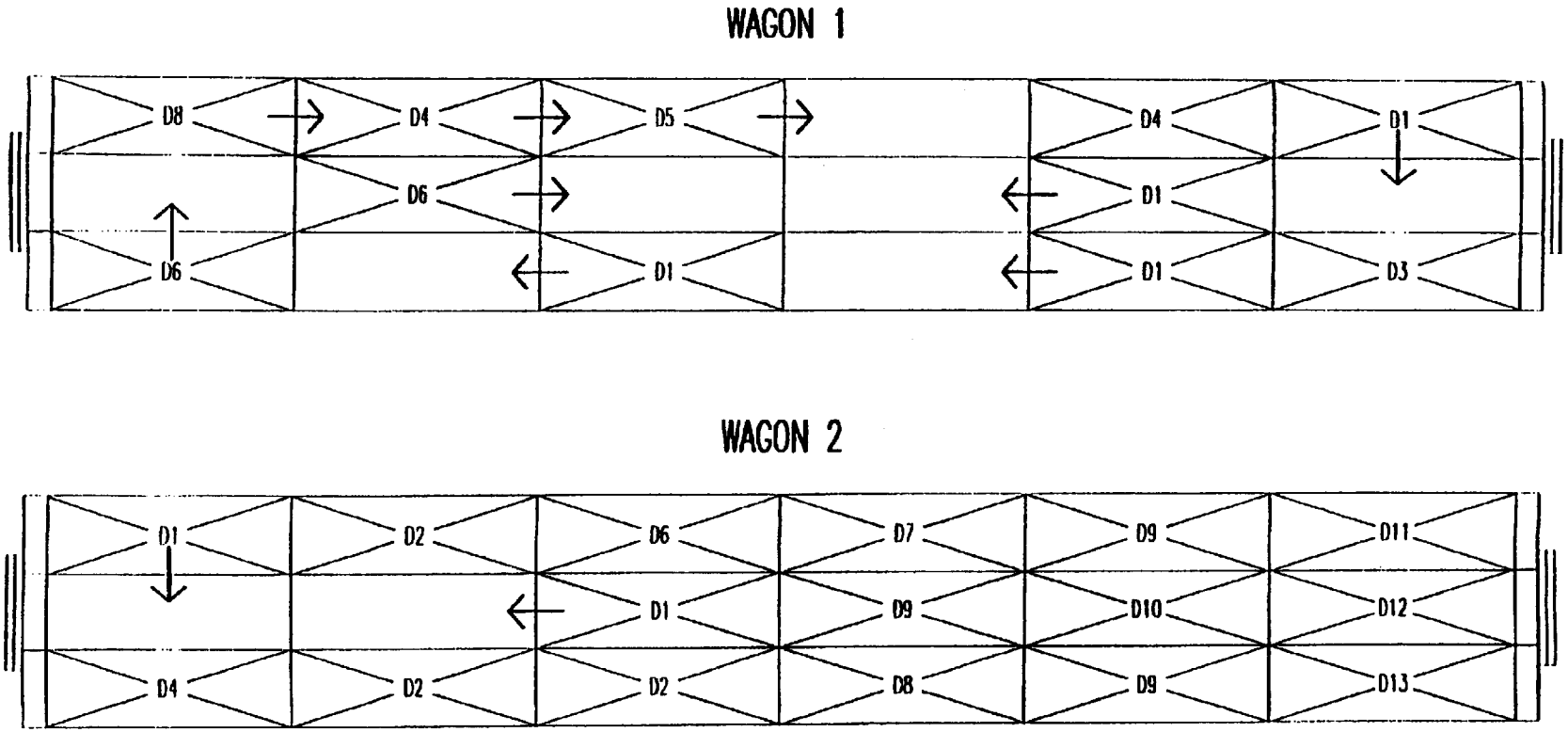
FIGS. 17 to 27 are schematic plan views from above showing the movement of loads within and between two connected containers of FIG. 1.
Figure 18:
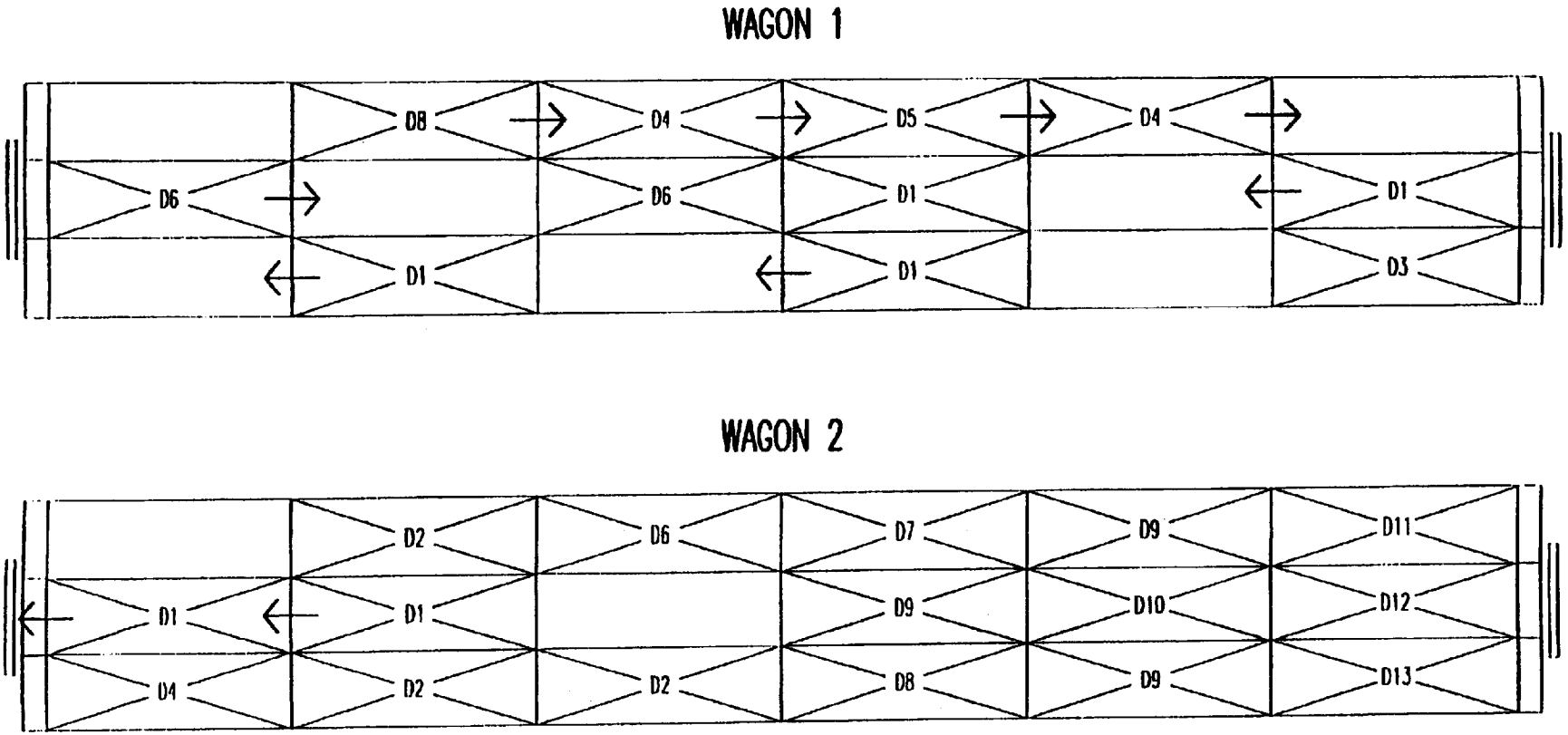
Figure 19:
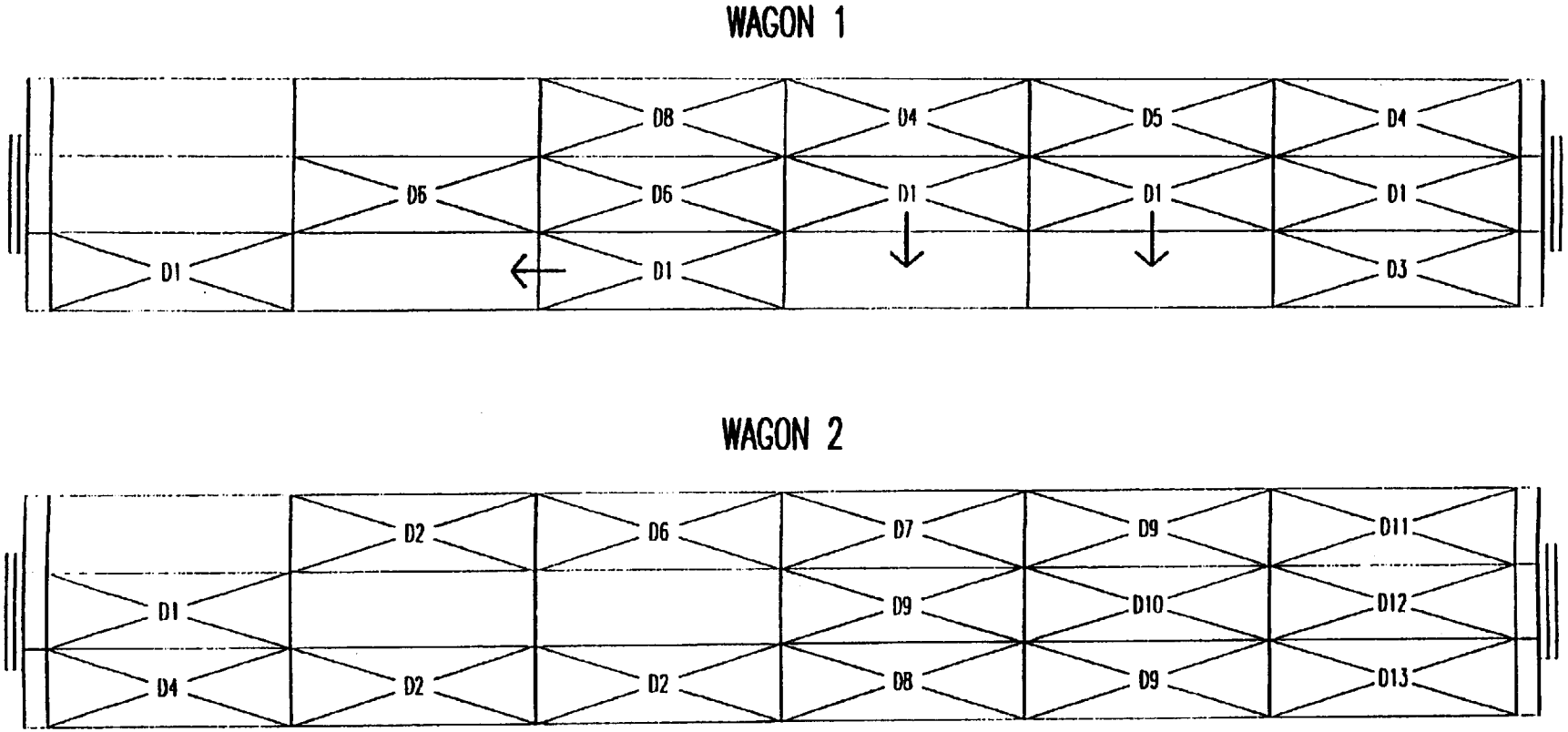
Figure 20:
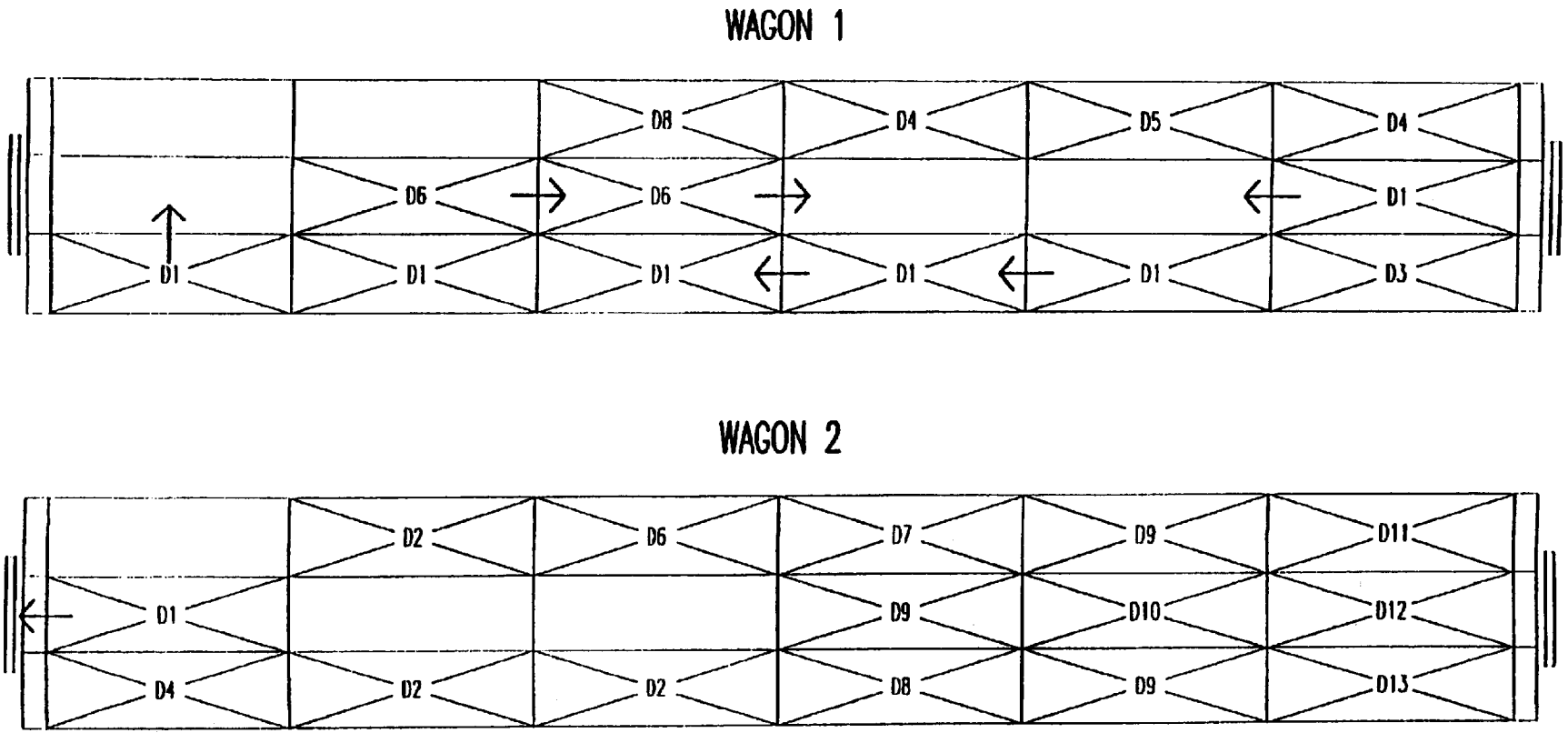
Figure 21:
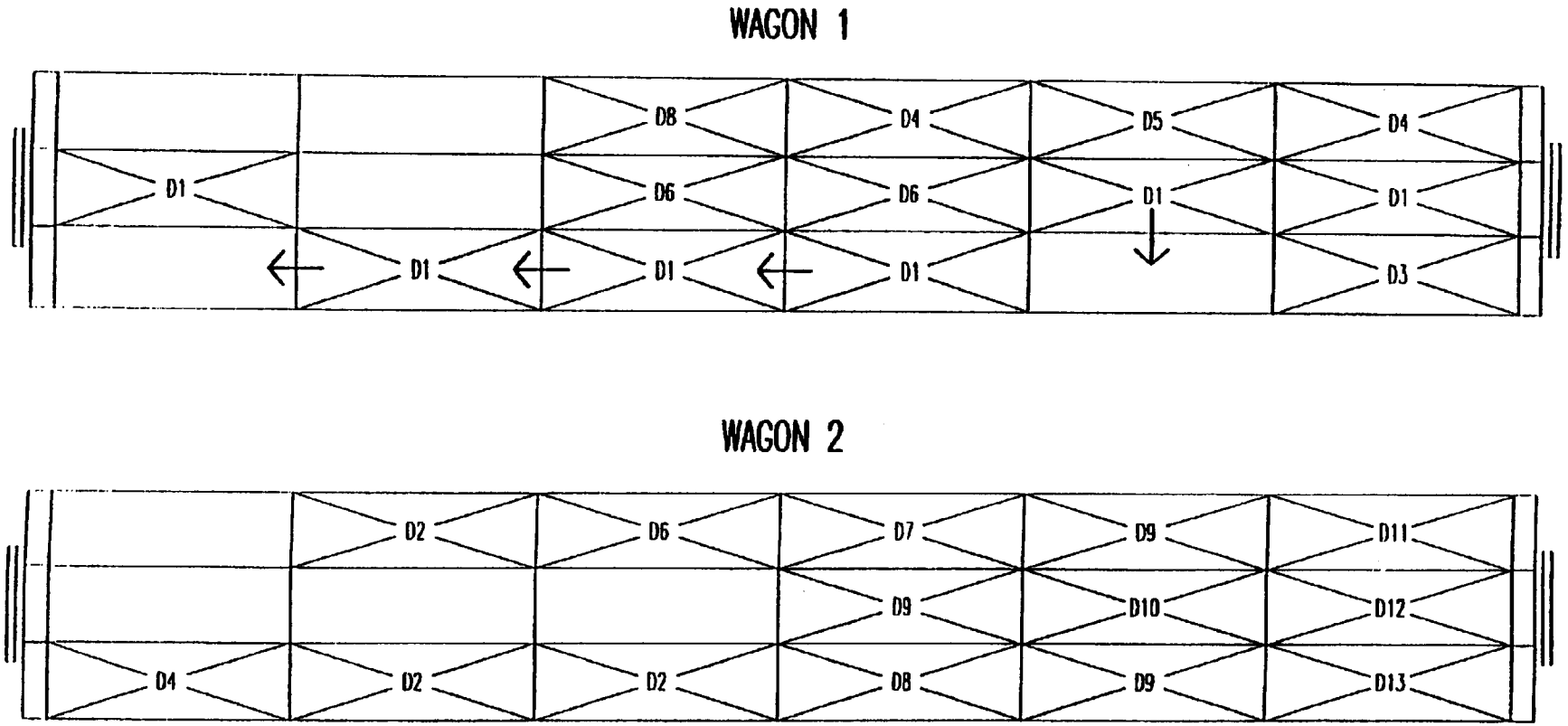
Figure 22:
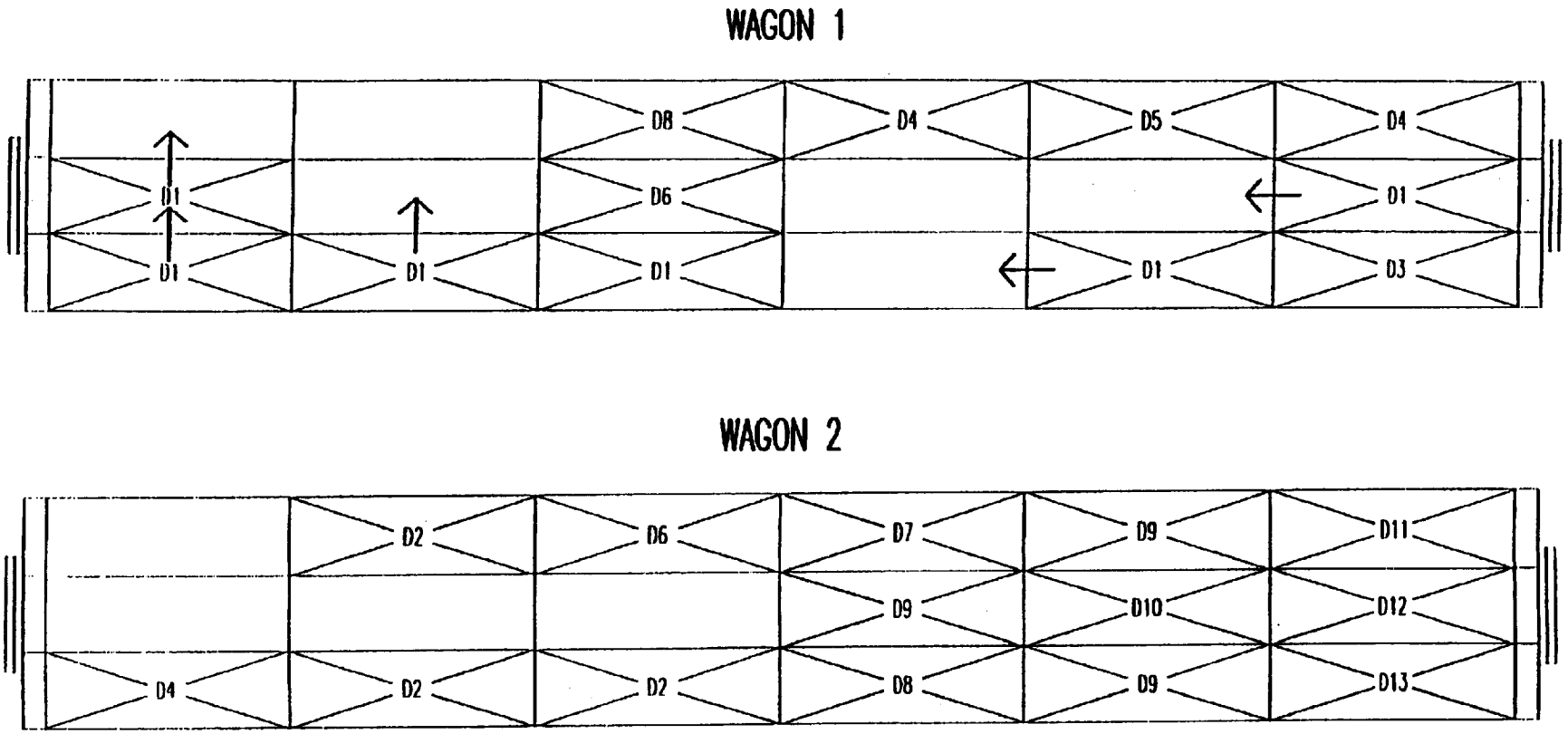
Figure 23:
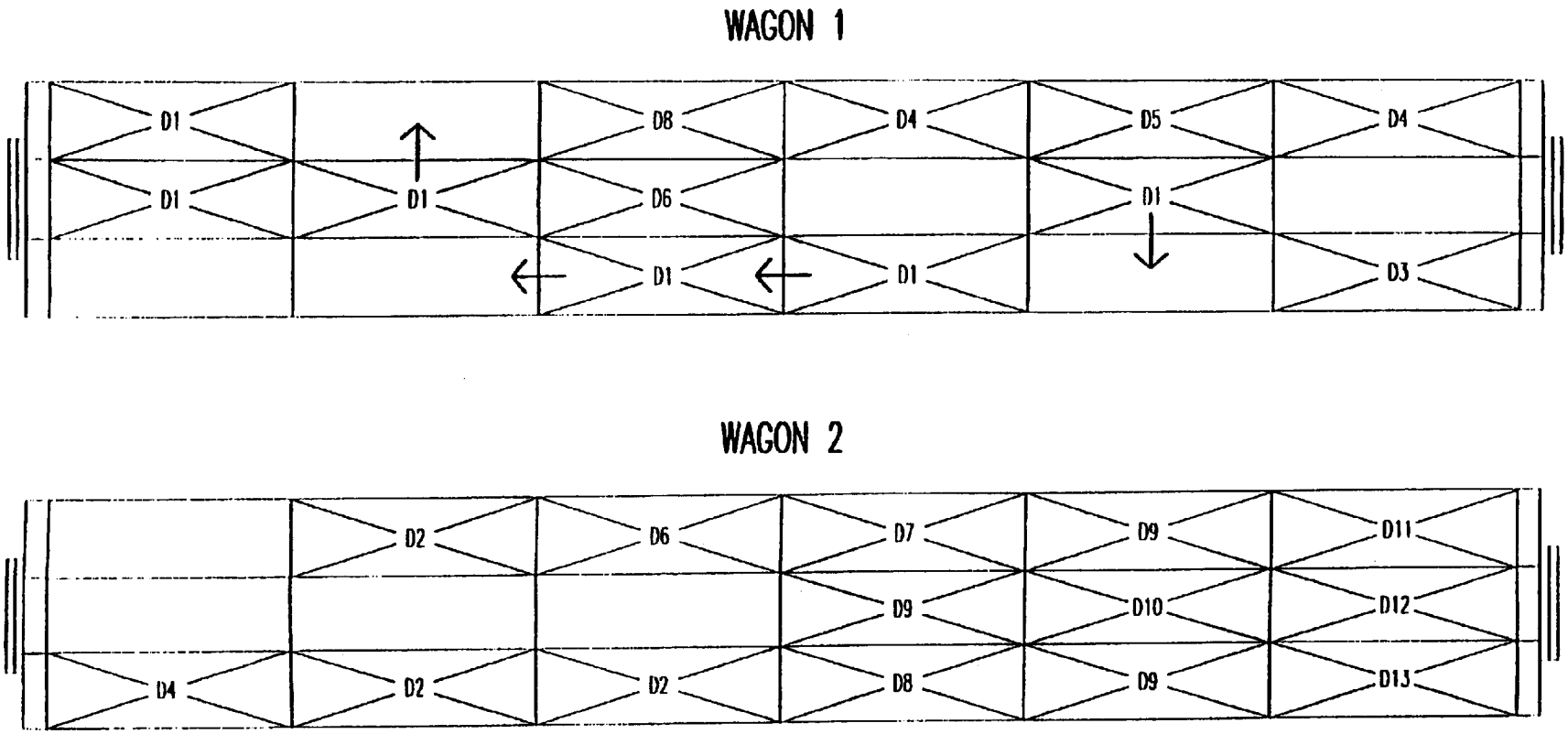
Figure 24:
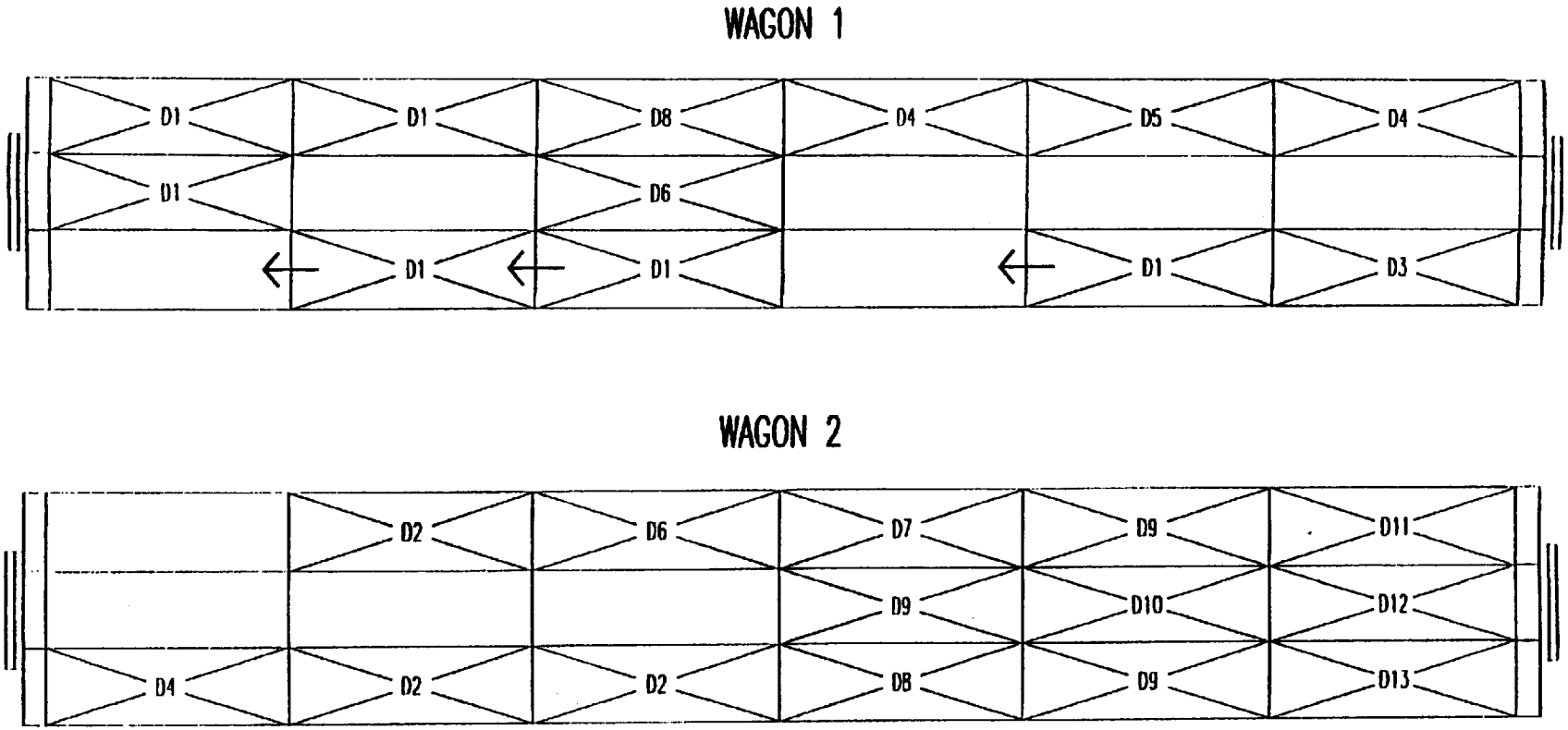
Figure 25:
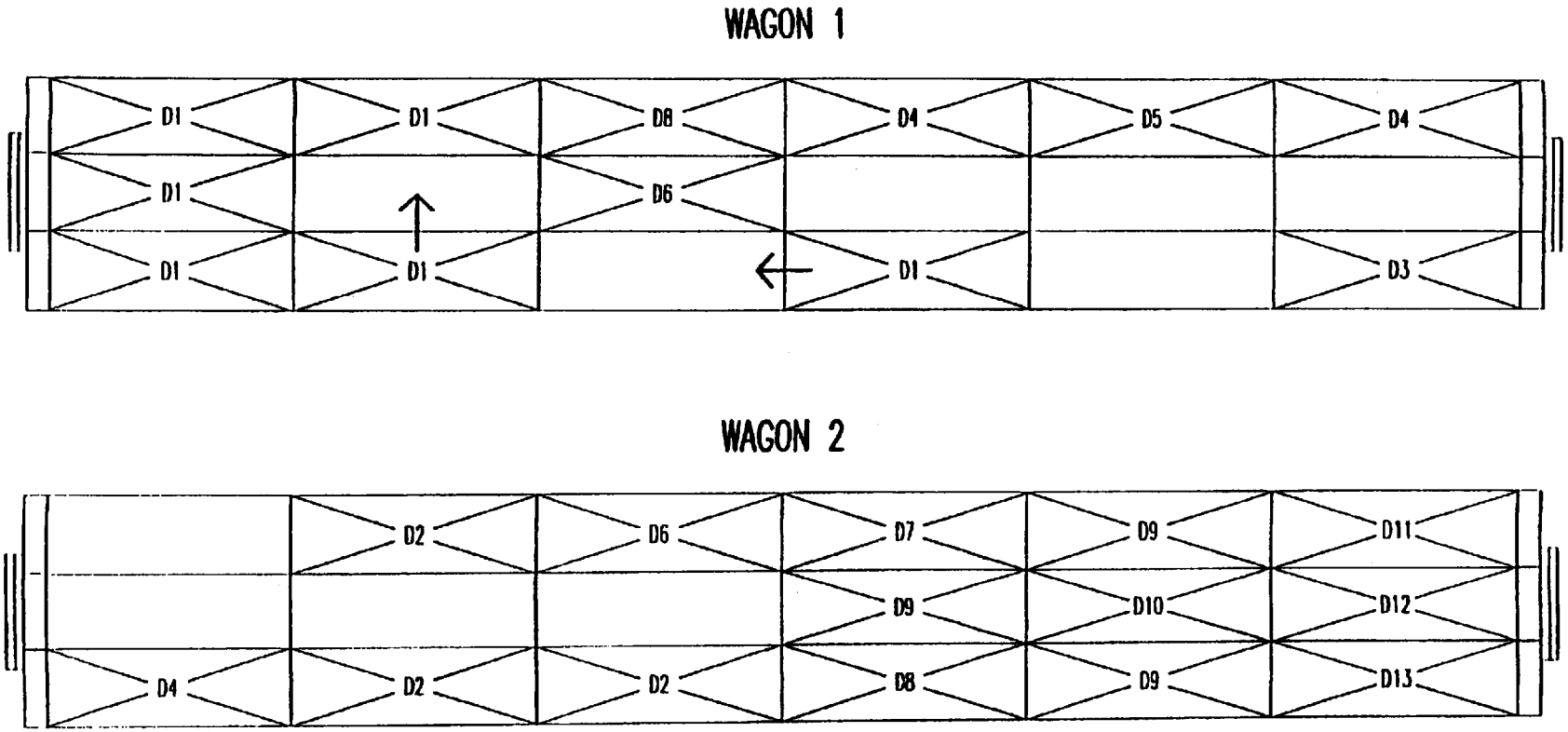
Figure 26:
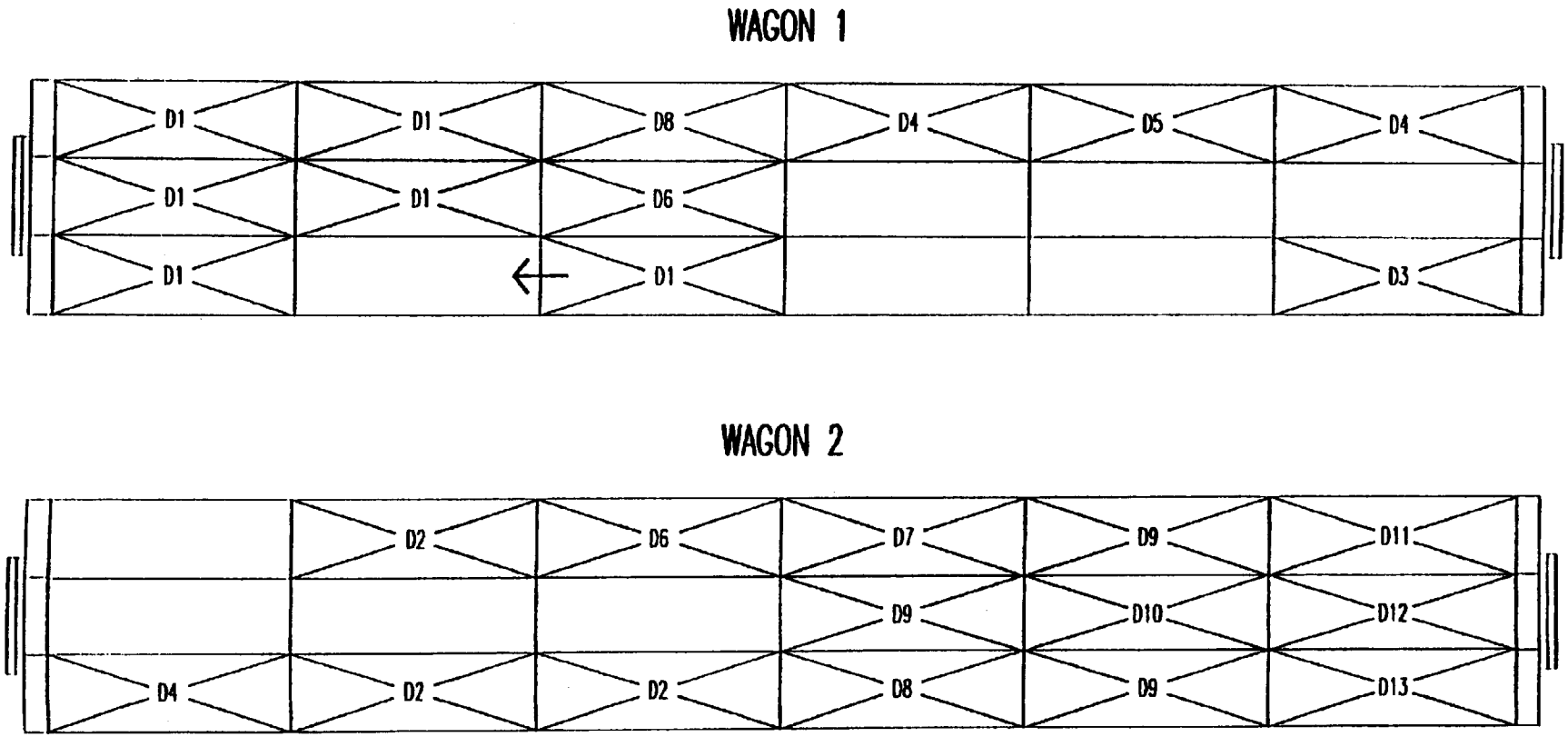
Figure 27:
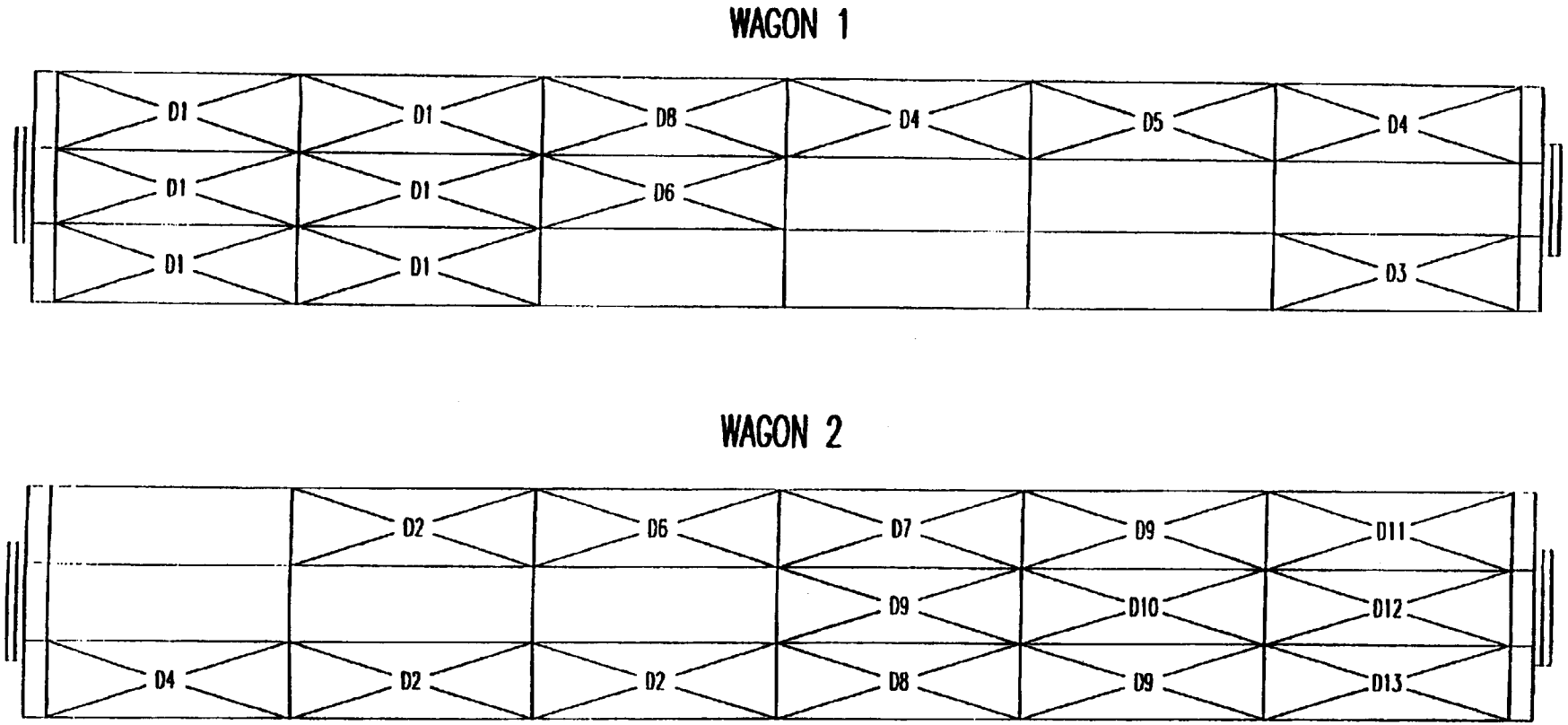

Referring now to FIGS. 15 and 16, in order to load or unload the wagon 1, the wagon 1 can be brought alongside a suitable loading/unloading station 75. In the example shown in the drawings, the loading/unloading station 75 is itself a rail wagon though the loading/unloading station may alternatively be a stationary fixture. An upper platform 76 of the loading/unloading station 75 can be driven laterally to meet the side of the wagon 1. The platform 76 can be moved up and down as necessary to bring it to the correct height to meet the wagon 1. The platform 76 is divided into discrete compartments 77 by dividing walls 78 so that the discrete compartments 77 of the loading/unloading station 75 correspond to the cells 7 and access doors 2 of the wagon 1. Each compartment 77 of the loading/unloading station 75 includes a conveying mechanism which can convey loads into and out of the wagon 1 by lateral movement as indicated in FIGS. 15 and 16. Each compartment 77 of the loading/unloading station 75 is bounded on the long sides of the loading/unloading station 75 by movable walls or by poles 79 interconnected by chains 80 to retain a load L in the compartment 77. Sensors (not shown) detect the position of loads L in each compartment 77.

The loading/unloading station 75 includes a controller in the form of a computer for example. The loading/unloading station controller is connected to the wagon controller by a suitable data transfer link such as cable or radio so that information can be transferred between the two controllers. In this manner, the wagon controller can inform the loading/unloading station controller which cells 7 in the wagon 1 are occupied and which are vacant and which can therefore receive a load. Moreover, the wagon controller can inform the loading/unloading station controller the location of loads in the wagon 1 which need to be unloaded and the unloading/loading station controller can operate the conveyors of the compartments 77 appropriately to unload those loads. The access doors 2 of the wagon 1 can automatically be opened as required under control of the wagon controller and/or the unloading/loading station controller. The conveyors 10 of each cell 7 in the wagon 1 and the dividers 8,9 are all operated as described above in order to allow the appropriate loads to be discharged from the wagon 1 and to allow the wagon 1 to receive loads.

Figure 29:
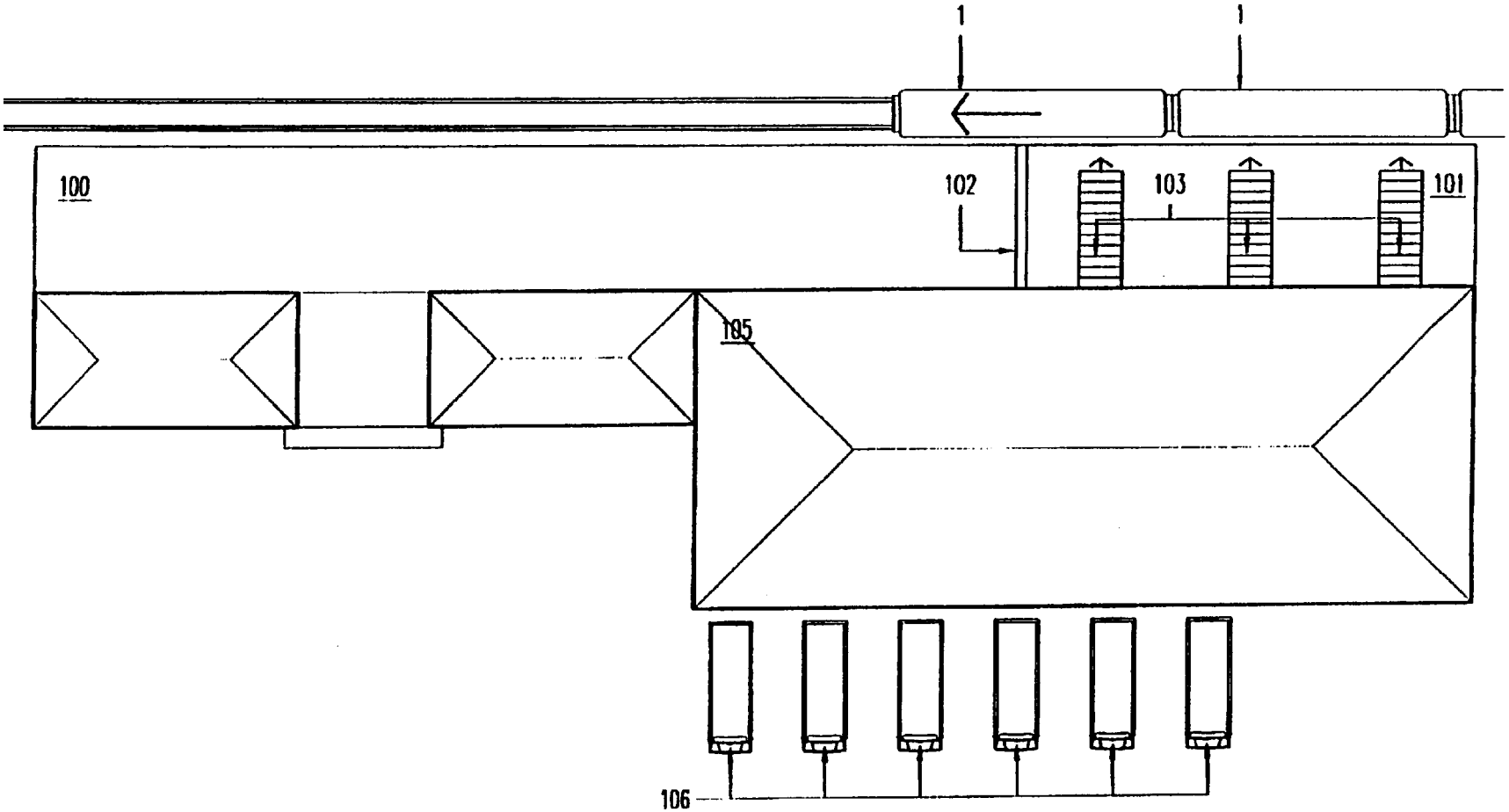
FIG. 29 is a view from above of a train pulling in with docking units moving to engage.
Figure 30:
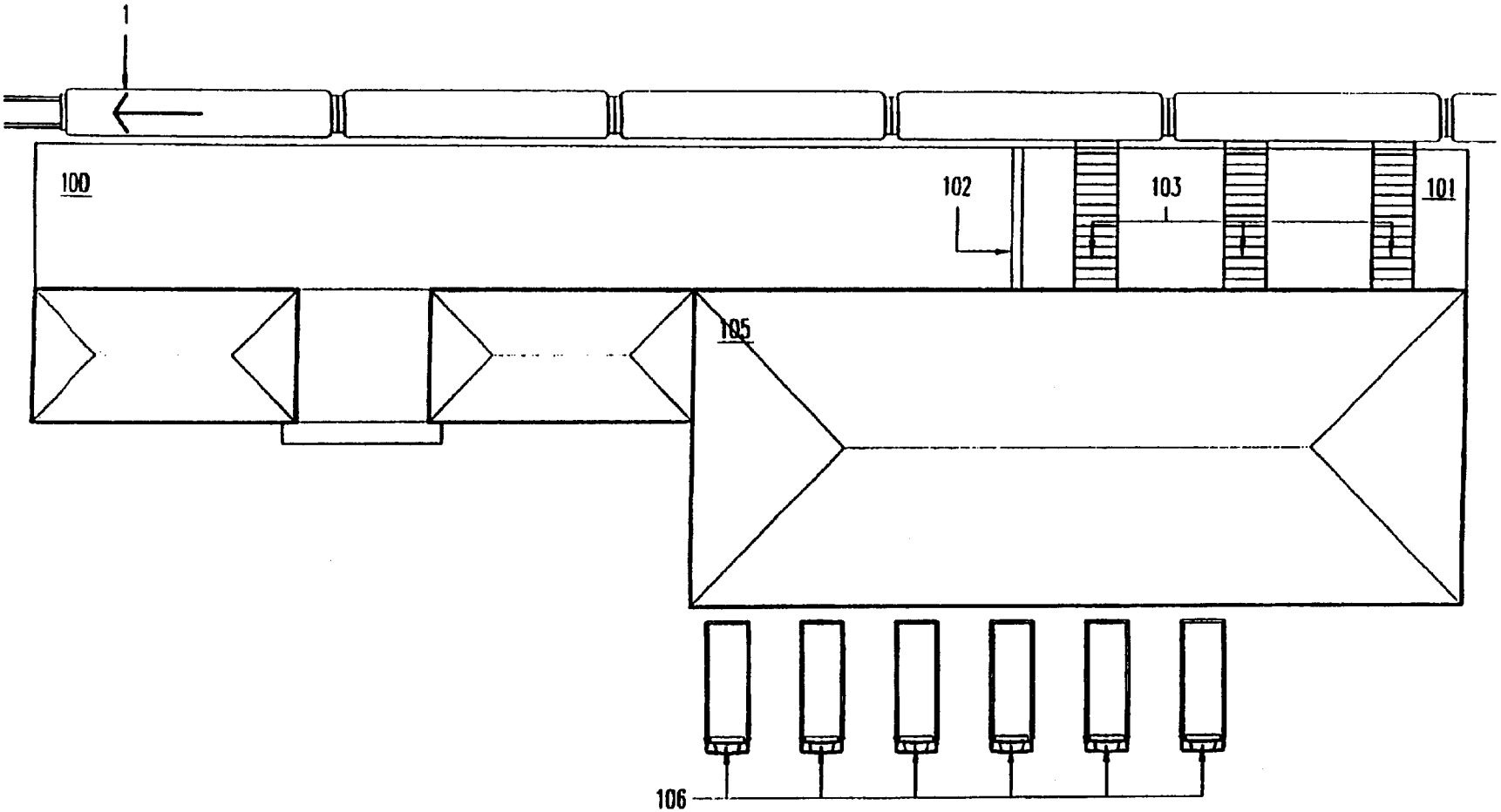
FIG. 30 is a view from above of a stationary train with docking units engaged.
Figure 31:
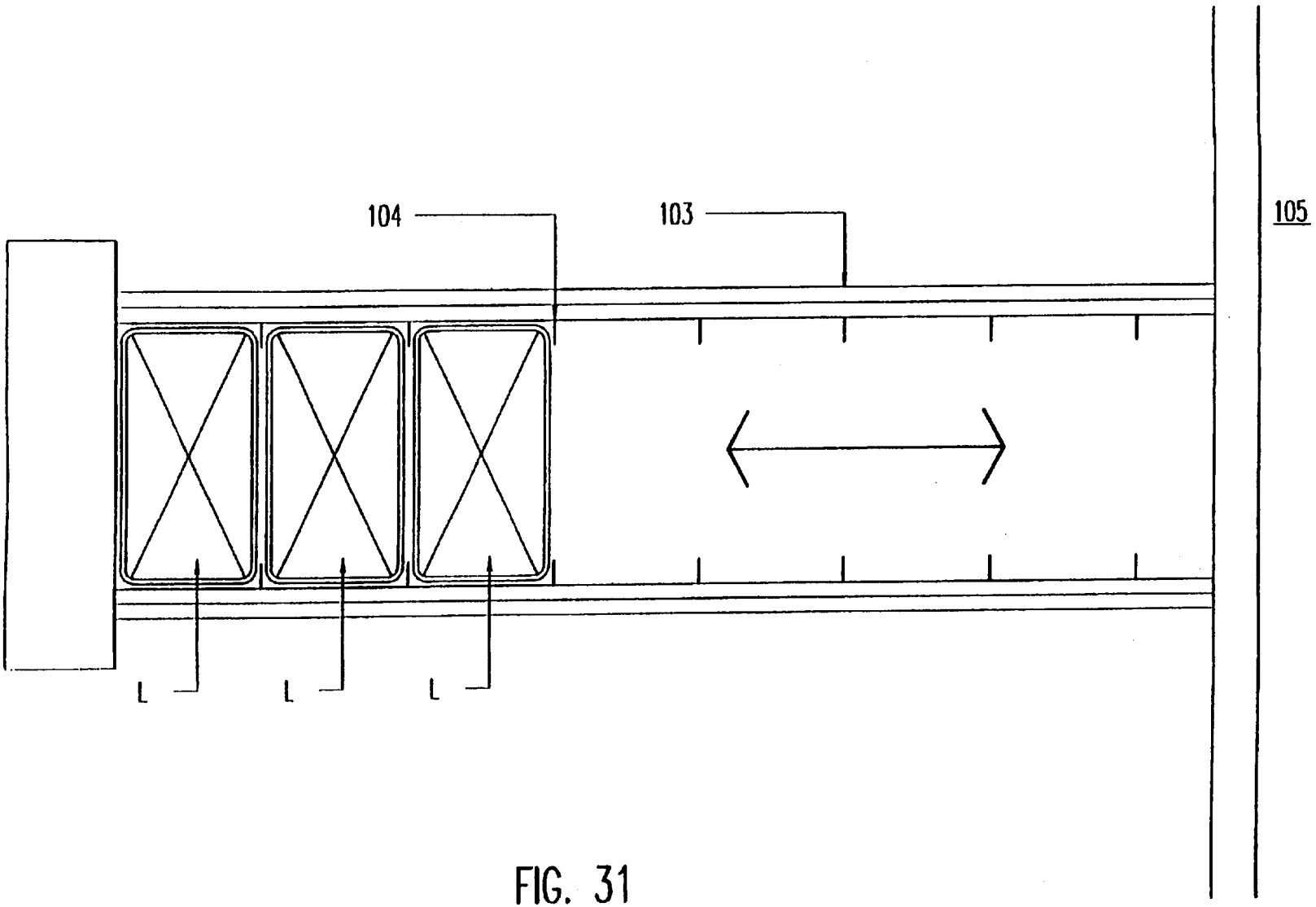
FIG. 31 is a view from above of a docking unit shown in FIGS. 29 and 30 with the roof removed for reasons of clarity; and, FIG. 32 is a view from above of a motorised wagon moving shuttling between a warehouse on a siding and a train on the main line.

Instead of the loading/unloading station 75, one or more docking units 103 may be used to load or unload the wagon 1 through movement towards and mechanical connection with wagon 1, as shown by way of example in FIGS. 29 to 31. The purpose of the docking units 103 is to load and unload wagons via internal conveying mechanisms 104 and move loads to and from a warehouse 105. Mechanisms (not shown), which may be of known type, are provided for ensuring that the wagon 1 comes to rest in exactly the right location for the docking units 103 to successfully line up and engage. Road vehicles 106 are shown parked for loading/unloading purposes.

The wagon 1 can assist in loading and unloading. Acting on instructions from an attached loading/unloading device such as a docking unit 103, loads resting on a cell 7 may be pushed into the docking unit 103 by the wagon 1 or accepted from the docking unit 103 by the wagon 1. This requires synchronisation between the control mechanisms of the wagon 1 and the docking units 103 to ensure trouble-free load transfer. Such synchronisation might take place via radio signal or cable connection, for example. Overall control would rest either with the wagon 1, a particular docking unit 103, or an entirely separate control centre, depending on convenience. If unloading is the current operation, when a load has been unloaded from a cell 7 by say a docking unit 103, the next load to be unloaded can then automatically be conveyed to that cell to be unloaded next. Similarly, during loading, loads can be moved into the container 1 from the cell or cells 7 which initially receive a load.

Health and safety requirements are likely to dictate that the loading/unloading area is set apart from passenger areas where loading/unloading takes place on a platform also used for passengers. This is indicated in FIGS. 29 and 30 which show a passenger area 100 and a freight area 101 separated by a barrier 102.

Figure 32:
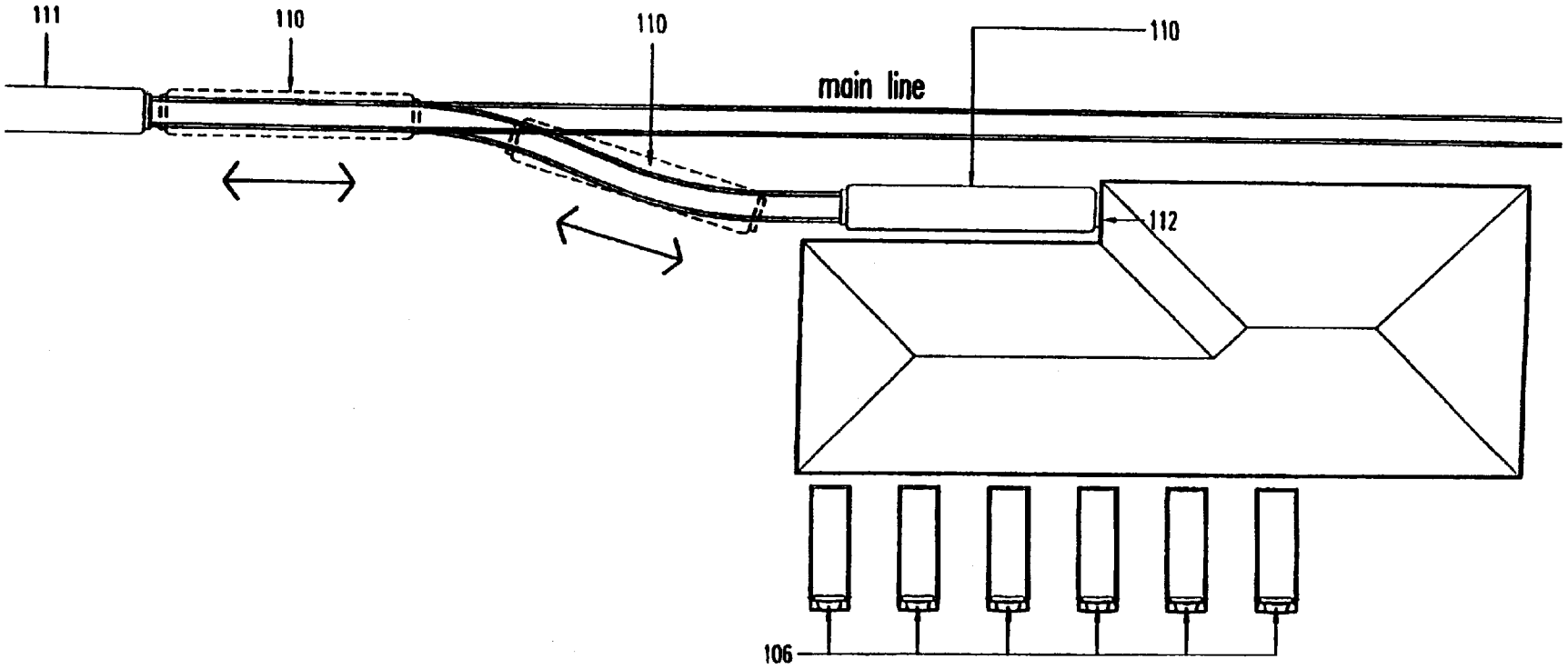

Additionally or alternatively, loads can be unloaded and loaded through the corridor connections 3 at either end of the wagon 1. As indicated schematically in FIG. 32, motorised wagons 110 may be provided for carrying freight between visiting freight trains 111 and a warehouse 112. Again, the warehouse 112 has vehicles 106 parked for loading/unloading purposes.

Within a warehouse 105, 112, movement of a load may be effected by a fork lift truck or similar apparatus. Such movement can alternatively be effected by automated mechanisms similar to those found in airports for moving and sorting luggage, for example.

In the event of mechanical failure, or in cases where only one or two loads need to be shipped, a fork lift truck may be used to place loads directly onto a wagon.

In order to allow loading and unloading of the wagon 1 to take place as quickly as possible, the loads L within the wagon 1 are sorted and redistributed amongst the cells 7 so that all loads intended for the same destination are collected together for example and/or are moved adjacent an access door 2 to allow those loads to be discharged rapidly. Such sorting can take place whilst the wagon 1 is in transit and therefore the wagon 1 only needs to halt whilst loading and unloading are actually taking place. It is not necessary for a person to sort the loads in the wagon 1 at the destination of the loads in order to locate the loads to be discharged from the wagon 1 for example. Moreover, it is often the case that a freight train is longer than the maximum platform length of a station where loads are to be loaded into or unloaded from the wagon 1. In such a case, it is therefore desirable to collect together all loads on the wagon 1 intended for that destination so that the train can simply be stopped at a position where the collected loads for that destination are in a wagon adjacent a platform or loading/unloading station at which position the loads for that destination can be discharged from the wagon 1. Other loads intended for other destinations can be moved away from the doors 2 so that new loads can be loaded into the wagon 1 more quickly at the next destination.

Whilst multiple access doors 2 are shown in the example of the wagon 1 described above, the wagon may have only one access door 1. In that case, loads for the next destination may be moved under the control of the controller to be adjacent the access door and other loads intended for other destinations moved away from the door so that new loads can be loaded more quickly into the wagon 1 at the next destination.

Failure of a cell 7, for example because of a failure of the conveyor 10 or in the dividers 8,9 bounding that cell 7 or in signal communications with that cell 7, can be detected by the controller. The sorting process can be adapted accordingly until repair can be effected.

In FIGS. 17 to 27, there is shown a sequence of events in which loads intended for the same destination D1 are collected together at the front of the first wagon "WAGON 1". Whilst the two wagons WAGON 1 and WAGON 2 are shown separately in FIGS. 17 to 27 for convenience, it will be understood that the two wagons WAGON 1 and WAGON 2 are in fact connected together with WAGON 1 leading WAGON 2.

Different destinations for the loads on the two wagons are indicated by D1, D2, etc. After the destinations of the various loads have been read by the readers 62 of the wagon 1, the wagon controller determines how to move the various loads within the wagons in accordance with a suitable algorithm such that all loads intended for the same destination (e.g. destination D1), which will normally be the next destination for the wagon 1, are collected together towards the front of WAGON 1, with loads being passed between the two wagons as necessary. All of the movements indicated in each of FIGS. 17 to 27 can take place simultaneously and can take place whilst the wagons are moving, with loads moving into adjacent cells 7 and loads moving out of cells 7 to make room for other loads to move into or pass through that cell 7 as required. When the train arrives at the destination D1, it is then necessary for the loading/unloading station 75 or fork lift truck or other unloading means to have access to the front two rows of cells 7 of the first wagon WAGON 1 only. This means that unloading of the train can be very rapid as it is not necessary to search through all loads in the train to determine which are intended for that destination D1. The wagon controller records that the various loads for that destination D1 have been discharged from WAGON 1 and that those cells 7 previously occupied by the loads for destination D1 are now empty.

Different trains can be temporarily connected to each other so that loads can be exchanged between the wagons 1 of the trains in order to optimise or speed distribution of the respective loads carried by the trains.

It will be appreciated that some cells 7 must always be empty in order to allow loads to be sorted within a wagon 1. Sorting of the loads will take longer as the proportion of cells which are occupied increases. The efficiency of the wagon 1 in terms of the proportion of cells occupied by loads needs to be balanced against the need to have some unoccupied cells in order to allow sorting of the loads to take place.

Figure 28:
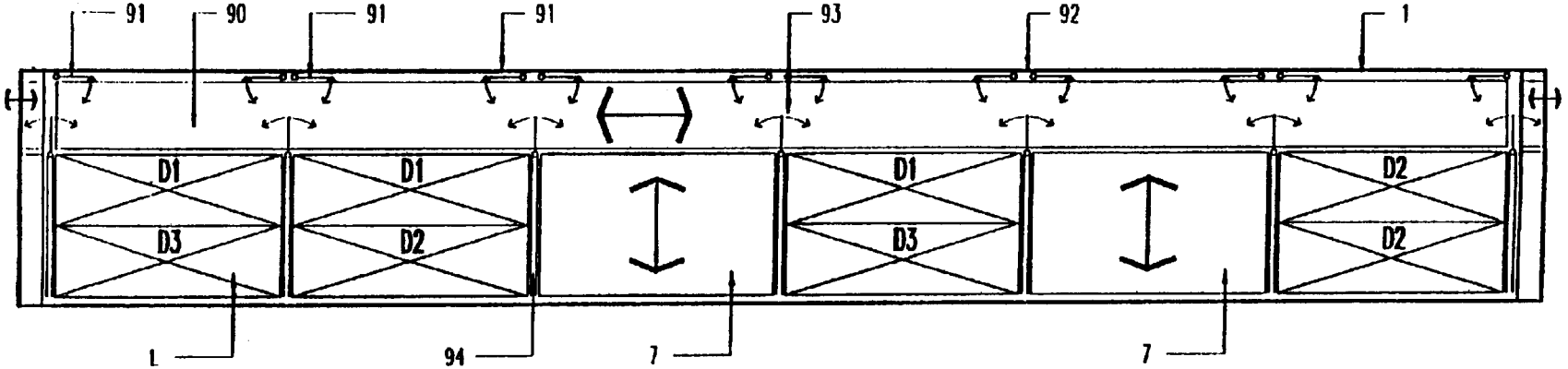
FIG. 28 is a plan view from above of the inside of a second example of a container according to the present invention.

In FIG. 28, a second example of a wagon 1 is shown. In this example, there are six cells 7 in the wagon 1 extending along the length of the wagon 1 with the cells 7 occupying approximately two-thirds of the width of the wagon 1. The remaining third of the width of the wagon 1 includes a conveyor 90 which may be in the form of horizontally rotating driven rollers or a horizontal driven belt for example. The conveyor 90 is used to convey a load to a position adjacent a cell 7 where the load is to be stored during transit. When the load is at a position adjacent the appropriate cell, pusher bars or gates 91 in the side wall 92 of the wagon 1 adjacent the conveyor 90 are operated to push the load into the adjacent cell 7. Each cell 7 has a lateral conveyor, for example in the form of a belt or rollers, which can be operated to allow loads to be drawn off of the longitudinal conveyor 90 of the wagon 1 into the cell 7 or to discharge loads from the cell 7 onto the longitudinal conveyor 90. Sensors 93 in the form of trigger arms 93 project over the longitudinal conveyor 90 from each of the walls 94 which divide the cells 7 from each other. The sensors 93 detect when a load on the conveyor 90 has passed a particular cell 7 so that the loads can be moved to the selected cell 7.

An embodiment of the present invention has been described with particular reference to the example illustrated. However, it will be appreciated that variations and modifications may be made to the example described within the scope of the present invention.

For example, there may be constraints on the maximum weight of load that can be carried in order to prevent damage to the cells and the various moving mechanisms. There may be constraints on the minimum weight of load that can be carried in order to ensure that a particular load is sufficiently heavy to be stable during transport between cells, during loading and unloading, and during actual transit. A weight detector may be provided in each cell to measure the weight of the load.

Furthermore, detectors may be provided for detecting whether there is a person or an animal within a wagon in order to prevent injury being caused to the person or animal and to prevent the wagon equipment being damaged. Such detectors may be of any of the known types such as infra red heat detectors, motion detectors, sound or pressure sensors, etc. A full scan of each wagon may be carried out prior to any sorting operation. In addition, "stop bars" (not shown) may be installed in all wagons and a token key system or similar used to minimise the risk of someone entering a wagon and being injured during a sorting process.

It will be appreciated that the apparatus and method described above can be used for any type of freight transport, including for example rail as principally described above, road, sea and air.

It will further be appreciated that sorting and conveying of the loads can take place whilst the container is stationary or in transit.

What is claimed is:

1. Apparatus for transporting a load from a source to a destination, the apparatus comprising:

a freight container comprising a plurality of cells each for containing a discrete load and a conveyor for conveying loads between cells; and, a controller for allocating the loads amongst the cells according to the destinations of the individual loads and controlling the conveyor to convey each load to its allocated cell, wherein the conveyor comprises moving apparatus for selectively moving a load into and out of a cell in a direction selected from a direction parallel to the direction of travel of the container and transverse to the direction of travel of the container.

2. Apparatus according to claim 1, wherein the cells are arranged in a horizontal plane.

3. Apparatus according to claim 2, wherein the cells are arranged in a horizontal array.

4. Apparatus according to claim 1, wherein the conveyor comprises unloading apparatus in each cell for unloading a load from the cell.

5. Apparatus according to claim 1, comprising reading apparatus for reading a destination address on a load and providing destination information for each load to the controller.

6. Apparatus according to claim 1, wherein the conveyor comprises at least one driven roller in each cell for carrying a load and moving said load in a first direction.

7. Apparatus according to claim 6, wherein the conveyor comprises moving apparatus in each cell for moving said load in a second direction, the second direction moving apparatus being operable to lift a load from the at least one driven roller to allow said load to be moved in said second direction.

8. Apparatus according to claim 7, wherein the second direction moving apparatus comprises at least one belt.

9. Apparatus for transporting a load from a source to a destination, the apparatus comprising:

a freight container comprising a plurality of cells each for containing a discrete load and a conveyor for conveying loads between cells; and, a controller for allocating the loads amongst the cells according to the destinations of the individual loads and controlling the conveyor to convey each load to its allocated cell, wherein each cell is separated from an adjacent cell by a divider which is movable to allow loads to be conveyed between adjacent cells.

10. Apparatus according to claim 9, comprising a detector for detecting when a load abuts a divider, the controller being operable on receipt of a signal from the detector indicating that a load abuts a divider to control the conveyor to move said load away from said divider.

11. Apparatus according to claim 1, wherein the container has plural access points for loading and unloading of loads.

12. Apparatus according to claim 1, wherein the container has a single access point for loading and unloading of loads.

13. Apparatus according to claim 7, wherein there are a plurality of said container each of said containers being connected to at least one other container such that a load can be transferred from one container to another container.

14. A method of transporting plural discrete loads in a container from at least one source to respective destinations, the container having a plurality of cells each for containing a discrete load, the method comprising:

loading said plural discrete loads into the container;

identifying which loads are intended for which destinations;

allocating the loads amongst the cells according to the destinations of the individual loads; and, conveying each load to its allocated cell, wherein the conveying is carried out whilst the container is in transit between a source and a destination.

15. A method according to claim 14, wherein the loads are all initially loaded into cells of the container, and the method further comprises redistributing the loads amongst the cells according to the destinations of the individual loads.

16. A method according to claim 14, wherein the loads are allocated amongst the cells so that all loads in the container intended for the same destination are conveyed to adjacent of substantially adjacent cells.

* * * * *